US011493870B2

(12) United States Patent
Furukawa

(10) Patent No.: US 11,493,870 B2
(45) Date of Patent: Nov. 8, 2022

(54) SHEET DISCHARGING APPARATUS, SHEET PROCESSING APPARATUS, AND IMAGE FORMING SYSTEM

(71) Applicant: CANON KABUSHIKI KAISHA, Tokyo (JP)

(72) Inventor: Hitoshi Furukawa, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/383,609

(22) Filed: Jul. 23, 2021

(65) Prior Publication Data

US 2022/0043385 A1 Feb. 10, 2022

(30) Foreign Application Priority Data

Aug. 7, 2020 (JP) ..... JP2020-134814

(51) Int. Cl.
*G03G 15/00* (2006.01)

(52) U.S. Cl.
CPC ... *G03G 15/6544* (2013.01); *B65H 2553/412* (2013.01); *B65H 2553/414* (2013.01); *G03G 2215/00827* (2013.01); *G03G 2215/00911* (2013.01)

(58) Field of Classification Search
CPC ..... G03G 2215/00911
See application file for complete search history.

(56) References Cited

U.S. PATENT DOCUMENTS

| | | | | |
|---|---|---|---|---|
| 6,145,826 | A * | 11/2000 | Kawata | B65H 31/10 271/215 |
| 2007/0090583 | A1* | 4/2007 | Brown | B65H 43/06 270/58.09 |
| 2015/0139670 | A1* | 5/2015 | Ahne | B65H 43/06 399/16 |

FOREIGN PATENT DOCUMENTS

| | | | |
|---|---|---|---|
| JP | H08175743 | A | 7/1996 |
| JP | 2001335236 | A | 12/2001 |
| JP | 2009286515 | A | 12/2009 |
| JP | 2010155676 | A * | 7/2010 |
| JP | 2012001339 | A * | 1/2012 |
| JP | 2017222486 | A * | 12/2017 |
| JP | 2017222486 | A | 12/2017 |

* cited by examiner

*Primary Examiner* — Jennifer Bahls
(74) *Attorney, Agent, or Firm* — Rossi, Kimms & McDowell LLP

(57) ABSTRACT

A sheet discharging apparatus includes a discharging portion configured to discharge a sheet, a supporting portion configured to support the sheet discharged by the discharging portion, a lifting portion configured to lift and lower the supporting portion, a transmissive sensor configured to output an output signal that changes in accordance with a position of an upper surface of the sheet supported by the supporting portion, a reflective sensor configured to output an output signal that changes in accordance with the position of the upper surface of the sheet supported by the supporting portion, and a controller configured to control the lifting portion and including a first determining portion configured to determine whether or not sheet detection by the transmissive sensor is possible and a second determining portion configured to determine whether or not sheet detection by the transmissive sensor is needed.

17 Claims, 9 Drawing Sheets

SHEET DISCHARGING APPARATUS, SHEET PROCESSING APPARATUS, AND IMAGE FORMING SYSTEM

BACKGROUND OF THE INVENTION

Field of the Invention

The present invention relates to a sheet discharging apparatus that discharges a sheet, a sheet processing apparatus that processes a sheet, and an image forming system that forms an image on a sheet.

Description of the Related Art

An image forming system of an electrophotographic system includes a sheet discharging apparatus that discharges a sheet on which an image has been recorded and then a process such as a binding process has been performed if necessary. As such a sheet discharging apparatus, an apparatus that lifts and lowers a tray on which discharged sheets are supported such that the height of the upper surface of the sheets supported on the tray is maintained at a constant height is known. Japanese Patent Laid-Open No. 2001-335236 discloses a transmissive sensor in which a light emitting portion and a light receiving portion are respectively disposed on the left side and the right side of the tray and which detects the position of the upper surface of the sheets when the sheets block an optical axis between the light emitting portion and the light receiving portion.

The light receiving portion of the transmissive sensor is known to be affected by disturbance light such as sunlight in some cases. If the apparatus is configured to always stop discharging a sheet to suppress erroneous operation relating to ascent and descent of the tray in the case where there is disturbance light, there might be generated a time in which the apparatus cannot be used. Japanese Patent Laid-Open No. 2009-286515 discloses disposing two transmissive sensors which have arrangements of the light emitting portion and the light receiving portion reversed from each other, and performing lifting/lowering control of the tray by using one of the sensors that is not affected by the disturbance light.

However, in the configuration according to Japanese Patent Laid-Open No. 2009-286515, two sensors that only differ from each other in the arrangement of the light emitting portion and the light receiving portion and that have substantially the same function are used, which allows the cost to increase to address the disturbance light.

SUMMARY OF THE INVENTION

The present invention provides a sheet discharging apparatus, a sheet processing apparatus, and an image forming system that can reduce influence of disturbance light with a simple configuration.

According to one aspect of the invention, a sheet discharging apparatus includes a discharging portion configured to discharge a sheet, a supporting portion configured to support the sheet discharged by the discharging portion, a lifting portion configured to lift and lower the supporting portion, a transmissive sensor including a first light emitting portion configured to emit light and a first light receiving portion configured to detect the light received from the first light emitting portion, the transmissive sensor being configured to output an output signal that changes in accordance with a position of an upper surface of the sheet supported by the supporting portion, a reflective sensor including a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion, and a controller configured to control the lifting portion and including a first determining portion configured to determine whether or not sheet detection by the transmissive sensor is possible and a second determining portion configured to determine whether or not sheet detection by the transmissive sensor is needed, wherein the controller is configured to, in a case where the first determining portion has determined that sheet detection by the transmissive sensor is possible, lift or lower the supporting portion by the lifting portion on a basis of the output signals of the transmissive sensor and the reflective sensor, in a case where the first determining portion has determined that sheet detection by the transmissive sensor is not possible and the second determining portion has determined that sheet detection by the transmissive sensor is not needed, lift or lower the supporting portion by the lifting portion on a basis of the output signal of the reflective sensor, and in a case where the first determining portion has determined that sheet detection by the transmissive sensor is not possible and the second determining portion has determined that sheet detection by the transmissive sensor is needed, stop discharge of a sheet to be discharged by the discharging portion.

According to another aspect of the invention, a sheet discharging apparatus includes a discharging portion configured to discharge a sheet, a supporting portion configured to support the sheet discharged by the discharging portion, a lifting portion configured to lift and lower the supporting portion, a transmissive sensor including a first light emitting portion configured to emit light and a first light receiving portion configured to detect the light received from the first light emitting portion, the transmissive sensor being configured to output an output signal that changes in accordance with a position of an upper surface of the sheet supported by the supporting portion, a reflective sensor including a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion, and a controller configured to control the lifting portion and including a first determining portion configured to determine whether or not sheet detection by the transmissive sensor is possible and a second determining portion configured to determine whether or not sheet detection by the transmissive sensor is needed, wherein the controller is configured to, in a case where the first determining portion has determined that sheet detection by the transmissive sensor is possible, lift or lower the supporting portion by the lifting portion on a basis of the output signals of the transmissive sensor and the reflective sensor, in a case where the first determining portion has determined that sheet detection by the transmissive sensor is not possible and the second determining portion has determined that sheet detection by the transmissive sensor is not needed, lift or lower the supporting portion by the lifting portion on a basis of the output signal of the reflective sensor, and in a case where the first determining portion has determined that sheet detection by the transmissive sensor is not possible and the second determining portion has determined that sheet detection by the transmissive sensor is needed, lift or lower the supporting portion by the lifting portion on a basis of information about a sheet to be discharged by the discharging portion.

According to still another aspect of the invention, a sheet discharging apparatus includes a discharging portion configured to discharge a sheet, a supporting portion configured to support the sheet discharged by the discharging portion, a lifting portion configured to lift and lower the supporting portion, a transmissive sensor including a first light emitting portion configured to emit light and a first light receiving portion configured to detect the light received from the first light emitting portion, the transmissive sensor being configured to output an output signal that changes in accordance with a position of an upper surface of the sheet supported by the supporting portion, a reflective sensor including a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion, and a controller configured to control the lifting portion, wherein the controller is configured to, in a case where an amount of light received by the first light receiving portion in a state in which the first light emitting portion is not emitting light is a first amount, lift or lower the supporting portion by the lifting portion on a basis of the output signals of the transmissive sensor and the reflective sensor, and in a case where the amount of light received by the first light receiving portion in the state in which the first light emitting portion is not emitting light is a second amount larger than the first amount, (i) if a grammage of the sheet to be discharged by the discharging portion is a first grammage, lift or lower the supporting portion by the lifting portion on a basis of the output signal of the reflective sensor, (ii) if an environmental humidity is a first humidity, lift or lower the supporting portion by the lifting portion on the basis of the output signal of the reflective sensor, and (iii) if the grammage of the sheet to be discharged by the discharging portion is a second grammage smaller than the first grammage and the environmental humidity is a second humidity higher than the first humidity, stop discharge of the sheet to be discharged by the discharging portion.

According to still another aspect of the invention, a sheet discharging apparatus includes a discharging portion configured to discharge a sheet, a supporting portion configured to support the sheet discharged by the discharging portion, a lifting portion configured to lift and lower the supporting portion, a transmissive sensor including a first light emitting portion configured to emit light and a first light receiving portion configured to detect the light received from the first light emitting portion, the transmissive sensor being configured to output an output signal that changes in accordance with a position of an upper surface of the sheet supported by the supporting portion, a reflective sensor including a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion, and a controller configured to control the lifting portion, wherein the controller is configured to, in a case where an amount of light received by the first light receiving portion in a state in which the first light emitting portion is not emitting light is a first amount, lift or lower the supporting portion by the lifting portion on a basis of the output signals of the transmissive sensor and the reflective sensor, and in a case where the amount of light received by the first light receiving portion in the state in which the first light emitting portion is not emitting light is a second amount larger than the first amount, (i) if a grammage of a sheet to be discharged by the discharging portion is a first grammage, lift or lower the supporting portion by the lifting portion on a basis of the output signal of the reflective sensor, (ii) if an environmental humidity is a first humidity, lift or lower the supporting portion by the lifting portion on the basis of the output signal of the reflective sensor, and (iii) if the grammage of the sheet to be discharged by the discharging portion is a second grammage smaller than the first grammage and the environmental humidity is a second humidity higher than the first humidity, lift or lower the supporting portion by the lifting portion in response to discharge of a sheet by the discharging portion.

Further features of the present invention will become apparent from the following description of exemplary embodiments with reference to the attached drawings.

DESCRIPTION OF THE EMBODIMENTS

Embodiments of the present disclosure will be described below with reference to drawings.

First Embodiment

Figure 1:
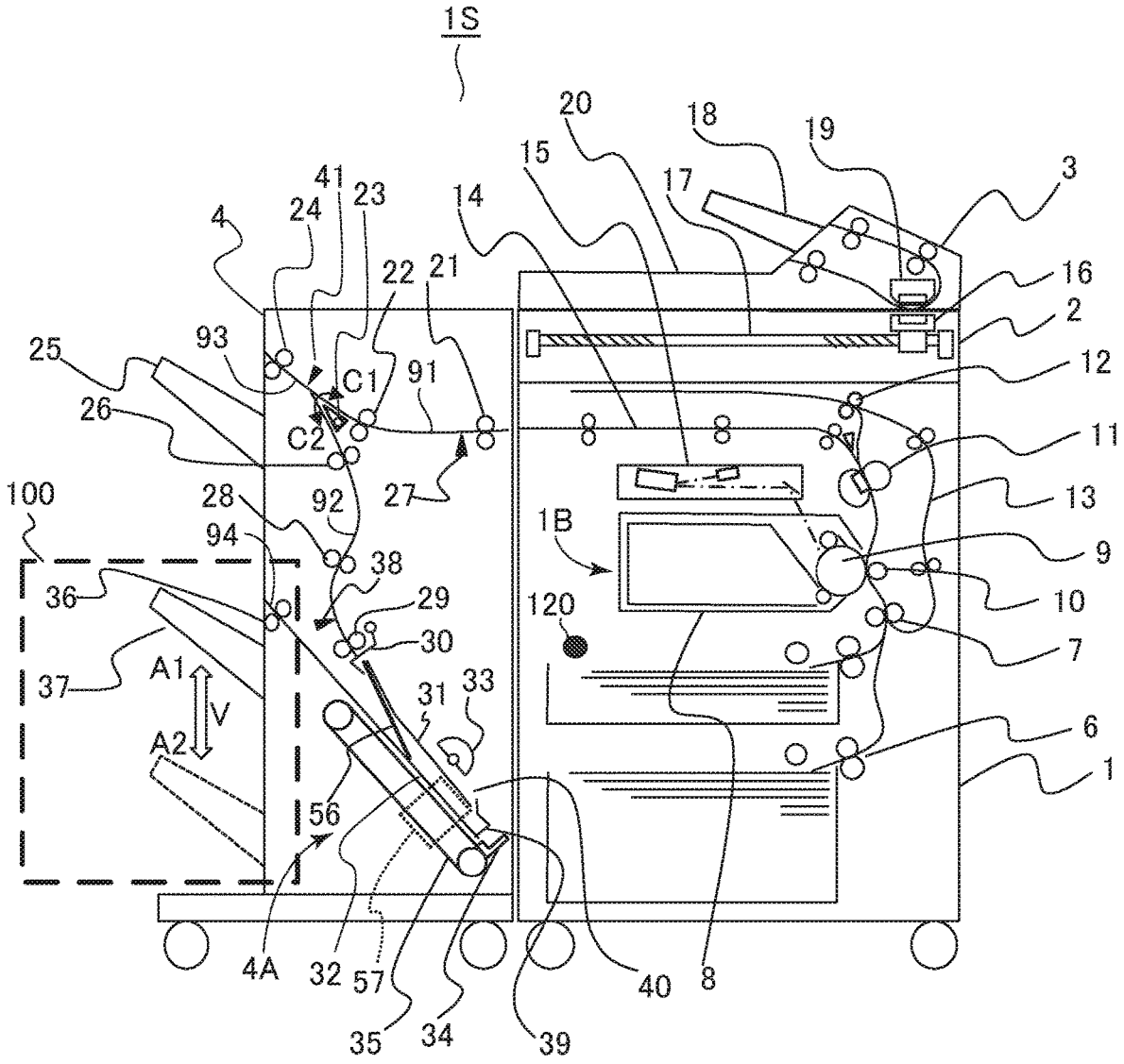
FIG. 1 is a schematic view of an image forming system according to a first embodiment.

As illustrated in FIG. 1, an image forming system 1S according to a first embodiment is constituted by an image forming apparatus 1, an image reading apparatus 2, a document feeding apparatus 3, and a sheet processing apparatus 4. The image forming system 1S forms an image on a sheet serving as a recording material, processes the sheet by the sheet processing apparatus 4 if necessary, and then outputs the sheet. Simple description of each apparatus will be given below, and then the sheet processing apparatus 4 will be described in detail.

The document feeding apparatus 3 conveys a document placed on a document tray 18 to image reading portions 16 and 19. The image reading portions 16 and 19 are each an image sensor that reads image information from a document surface, and both surfaces of the document are read in one time of document conveyance. The document whose image information has been read is discharged onto a document discharge portion 20. In addition, the image reading apparatus 2 can read image information from a still document set on a platen glass by reciprocating the image reading portion 16 by a driving device 17. Examples of the still document include documents not compatible with the document feeding apparatus 3 such as booklet documents.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the photosensitive drum 9 that is rotating is charged, and the laser scanner unit 15 exposes the photosensitive drum 9 on the basis of image information to draw an electrostatic latent image on the surface of the photosensitive drum 9. The electrostatic latent image borne on the photosensitive drum 9 is developed into a toner image with charged toner particles, and the toner image is conveyed to a transfer portion where the photosensitive drum 9 and a transfer roller 10 oppose each other. A controller of the image forming apparatus 1 serving as a printer controller executes an image forming operation by the image forming portion 1B on the basis of image information read by the image reading portions 16 and 19 or image information received from an external computer via a network.

The image forming apparatus 1 includes multiple feeding apparatuses 6 that each feed a plurality of sheets serving as recording materials one by one at predetermined intervals. A sheet fed from one of the feeding apparatuses 6 is conveyed to registration rollers 7, the skew thereof is corrected by the registration rollers 7, then the sheet is conveyed to the transfer portion, and the toner image borne on the photosensitive drum 9 is transferred onto the sheet in the transfer portion. A fixing unit 11 is disposed downstream of the transfer portion in the sheet conveyance direction. The fixing unit 11 includes a rotary member pair that nips and conveys the sheet, and a heat generation member such as a halogen lamp for heating the toner image, and performs a fixing process of the toner image by heating and pressurizing the toner image on the sheet.

In the case of discharging the sheet on which an image has been formed to the outside of the image forming apparatus 1, the sheet having passed through the fixing unit 11 is conveyed to the sheet processing apparatus 4 through a horizontal conveyance portion 14. In the case of a sheet on a first surface of which an image has been formed in duplex printing, the sheet having passed through the fixing unit 11 is passed onto reverse conveyance rollers 12, is switched back and conveyed by the reverse conveyance rollers 12, and is then conveyed to the registration rollers 7 again through a reconveyance portion 13. Then, the sheet passes through the transfer portion and the fixing unit 11 again, thus an image is formed on a second surface thereof, and then the sheet is conveyed to the sheet processing apparatus 4 through the horizontal conveyance portion 14.

The image forming portion 1B described above is an example of an image forming portion that forms an image on a sheet, and an electrophotographic unit of an intermediate transfer system that transfers a toner image formed on a photosensitive member onto a sheet via an intermediate transfer member may be used as the image forming portion. In addition, a printing unit of an inkjet system or an offset printing system may be used as the image forming portion.

Sheet Processing Apparatus

The sheet processing apparatus 4 includes an inlet path 91, an in-body discharge path 92, a first discharge path 93, and a second discharge path 94 as conveyance paths for conveying sheets, and an upper discharge tray 25 and a lower discharge tray 37 as discharge destinations to discharge the sheets to. The lower discharge tray 37 is disposed below the upper discharge tray 25 in an up-down direction V that is a gravity direction. The inlet path 91 serving as a first conveyance path is a conveyance path in which a sheet is received and conveyed from the image forming apparatus 1. The in-body discharge path 92 serving as a second conveyance path is a conveyance path which is disposed below the inlet path 91 and in which a sheet is received from the inlet path 91 and guided toward a binding processing portion 4A. The first discharge path 93 is a conveyance path through which the sheet is discharged onto the upper discharge tray 25, and the second discharge path 94 serving as a third conveyance path is a conveyance path which extends from an intermediate supporting portion 39 toward bundle discharge rollers 36 and in which the sheet is guided to the bundle discharge rollers 36.

The sheet discharged from the horizontal conveyance portion 14 of the image forming apparatus 1 is received by inlet rollers 21 serving as a conveyance portion disposed on the inlet path 91, and conveyed toward pre-inversion rollers 22 through the inlet path 91. An entrance sensor 27 whose output value such as a voltage value or an output signal changes on the basis of the presence or absence of a sheet at a detection position between the inlet rollers 21 and the pre-inversion rollers 22 is provided on the inlet path 91. The pre-inversion rollers 22 convey the sheet received from the inlet rollers 21 toward the first discharge path 93.

To be noted, the sheet conveyance speed of the inlet rollers 21 may be set to a value higher than that in the horizontal conveyance portion 14 such that the sheet conveyance speed increases when the sheet is received by the inlet rollers 21. In this case, it is preferable that a one-way clutch is provided between a conveyance roller in the horizontal conveyance portion 14 and a motor that drives the conveyance roller, and the conveyance roller freewheels in the case where the sheet is pulled by the inlet rollers 21.

In the case where the discharge destination of the sheet is the upper discharge tray 25 serving as a first supporting portion, the sheet is guided to the first discharge path 93 by a guide member 23 provided at a branching portion between the inlet path 91 and the in-body discharge path 92. Reverse conveyance rollers 24 serving as a first discharging portion are provided on the first discharge path 93, and the reverse conveyance rollers 24 discharge the sheet received from pre-inversion rollers 22 onto the upper discharge tray 25.

In the case where the discharge destination of the sheet is the lower discharge tray 37 serving as a second supporting portion, the reverse conveyance rollers 24 serving as a reverse portion switch back the sheet received from the pre-inversion rollers 22 and convey the sheet to the in-body discharge path 92. Specifically, the sheet is guided to the first discharge path 93 in a state in which the guide member 23 has pivoted in a C2 direction. Then, after the trailing end of the sheet has passed an inversion sensor 41, the reverse conveyance rollers 24 rotate in a reverse direction, and the guide member 23 pivots in a C1 direction. As a result of this, the sheet is conveyed to the in-body discharge path 92. That is, the in-body discharge path 92 guides the sheet in a direction opposite to the inlet path 91. The inversion sensor 41 functions as a discharge destination switching sensor used for switching the discharge destination of the sheet from the upper discharge tray 25 to the lower discharge tray 37.

In-body discharge rollers 26, intermediate conveyance rollers 28, and kick-out rollers 29 each serving as a rotary member pair disposed on the in-body discharge path 92 sequentially pass the sheet received from the reverse conveyance rollers 24 onto each other and convey the sheet toward the binding processing portion 4A. A pre-intermediate supporting sensor 38 detects the sheet at a position between the intermediate conveyance rollers 28 and the kick-out rollers 29. As the entrance sensor 27, the pre-intermediate supporting sensor 38, and the inversion sensor 41, for example, optical sensors that detect the presence or absence of a sheet at the detection position by using light, or flag sensors that each include a flag pressed by the sheet are used.

The binding processing portion 4A serving as a processing portion includes a bundle pressing flag 30, the intermediate supporting portion 39 serving as a third supporting portion, a stapler 57, a bundle discharge guide 34, and a driving belt 35, and performs an alignment process on sheets. The intermediate supporting portion 39 is constituted by an intermediate upper guide 31 and an intermediate lower guide 32, and a plurality of sheets are supported thereon as a sheet bundle. The sheet bundle discharged toward the intermediate supporting portion 39 by the kick-out rollers 29 constituted by a roller pair is pressed against the intermediate lower guide 32 by the bundle pressing flag 30.

Then, the sheet bundle discharged onto the intermediate supporting portion 39 is guided downward along the intermediate lower guide 32, and brought into contact with a longitudinal alignment plate provided at a downstream end portion of the intermediate supporting portion 39 in the sheet conveyance direction by a semicircular roller 33. In addition, the sheet bundle aligned in the sheet conveyance direction by the longitudinal alignment plate is aligned in a width direction perpendicular to the sheet conveyance direction by unillustrated lateral alignment plates. To be noted, the semicircular roller 33 is set to have such a conveyance pressure on the sheet bundle aligned on the intermediate supporting portion 39 as to slip on the sheet bundle.

After such an alignment process has been performed, the sheet bundle is subjected to a binding process by the stapler 57 serving as a processing portion. Then, the bound sheet bundle is pushed out by the bundle discharge guide 34 fixed to the driving belt 35, and is passed onto the bundle discharge rollers 36 through the second discharge path 94. The sheet bundle is discharged to the outside by the bundle discharge rollers 36 serving as a second discharging portion, and is supported on the lower discharge tray 37. To be noted, the stapler 57 is an example of a processing portion, and a processing portion that performs a different process on the sheets may be used. Examples of the different processing portion include a processing unit that performs a center binding process in which the sheet bundle is folded in half, that is, folded at the center, and the center portion of the sheet bundle is stapled. In addition, examples of the process performed on the sheet also include a process so-called jog discharge in which sheets are discharged while displacing the alignment position of the sheet bundle for every predetermined number of sheets.

The lower discharge tray 37 is movable in the up-down direction V, which is an approximate vertical direction, with respect to the casing of the sheet processing apparatus 4. The sheet processing apparatus 4 includes a sensor that detects the presence or absence of a sheet supported on the lower discharge tray 37, a sensor that detects the position of the upper surface of sheets supported on the lower discharge tray 37, that is, the height of the uppermost sheet in the up-down direction V, and so forth. The discharge tray 37 is controlled on the basis of output signals of these sensors so as to descend in an A2 direction as the amount of sheets supported on the discharge tray 37 increases. In addition, the discharge tray 37 is controlled to ascend in an A1 direction toward an initial position when the sheets are removed from the discharge tray 37. A sheet discharging portion 100 including the lower discharge tray 37 capable of ascending and descending will be described below.

To be noted, in the configuration example of the present embodiment, the upper discharge tray 25 is a fixed member fixed to the casing of the sheet processing apparatus 4. However, the upper discharge tray 25 may be also configured to be capable of ascending and descending similarly to the lower discharge tray 37. In this case, a configuration similar to that of the sheet discharging portion 100 that will be described later may be applied to the upper discharge tray 25.

Sheet Discharging Portion

Figure 2A:
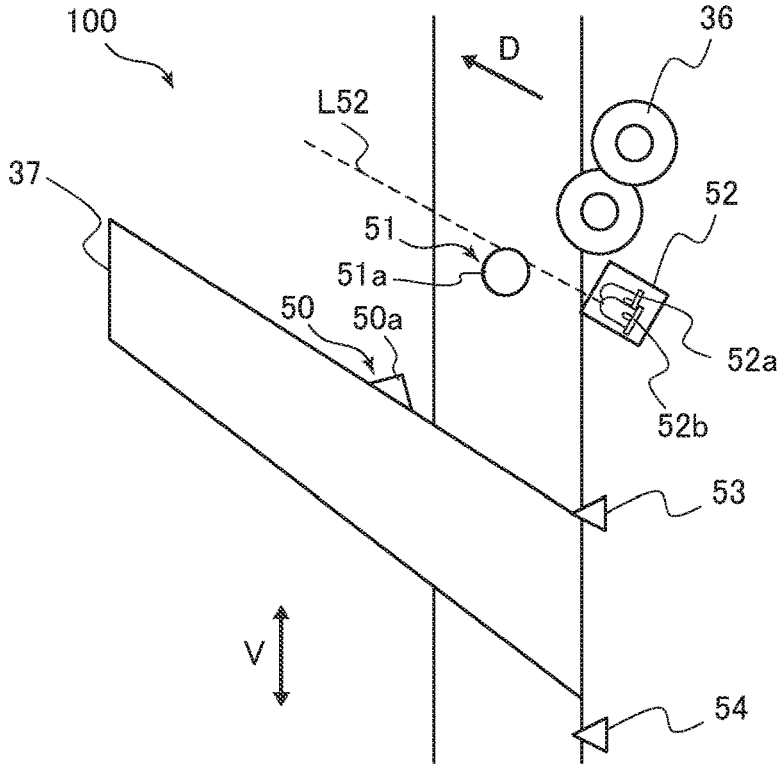
FIGS. 2A and 2B are each a schematic view of a sheet discharging portion according to the first embodiment.
Figure 2B:
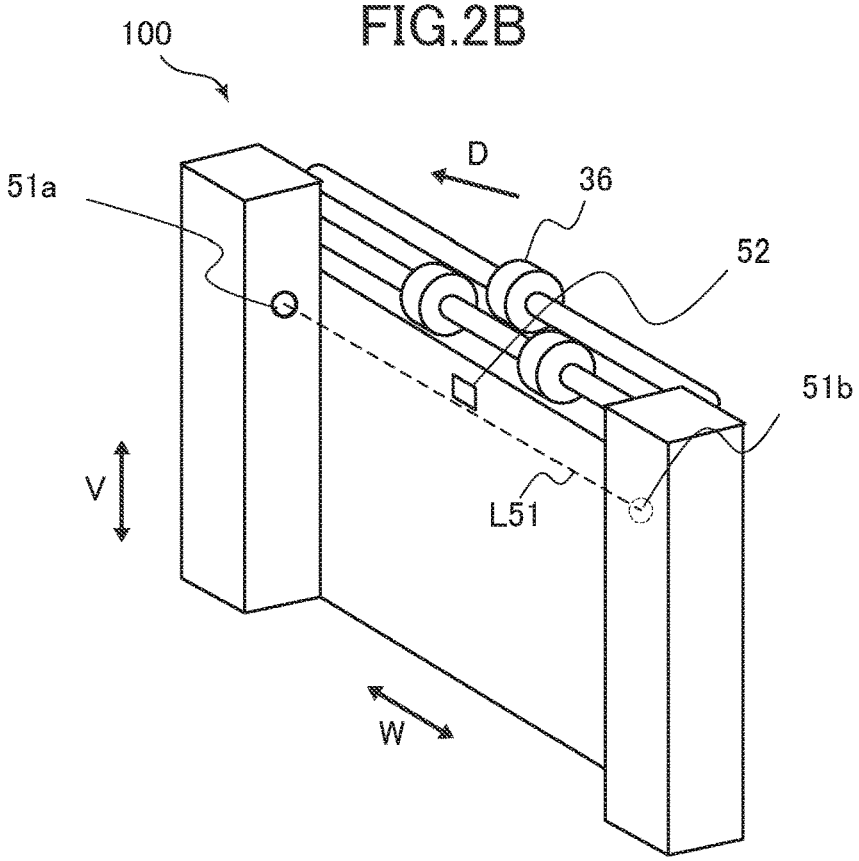

FIGS. 2A and 2B illustrate a configuration of the sheet discharging portion 100 serving as a sheet discharging apparatus of the present embodiment. FIG. 2A is a section view of the sheet discharging portion 100 illustrating a schematic configuration thereof. FIG. 2B is a perspective view of the sheet discharging portion 100 illustrating a schematic configuration thereof. In the description below, a direction in which the sheet is discharged to the outside from the sheet processing apparatus 4 will be referred to as a "sheet discharging direction D", and a direction perpendicular to the sheet discharging direction D and the up-down direction V, that is, the rotation axis direction of the bundle discharge rollers 36 will be referred to as a "sheet width direction W".

The sheet discharging portion 100 includes the bundle discharge rollers 36 serving as a discharging portion and the discharge tray 37 serving as a supporting portion or a stacking portion. The bundle discharge rollers 36 are a roller pair that nips a sheet bundle processed by the binding processing portion 4A and convey the sheet bundle in the sheet discharging direction D to discharge the sheet bundle to the outside of the sheet processing apparatus 4. The discharge tray 37 is a lifting tray that ascends and descends with respect to the sheet processing apparatus 4.

In addition, the sheet discharging portion 100 includes a sheet presence/absence sensor 50, an upper limit sensor 53, a lower limit sensor 54, a transmissive upper surface sensor 51, and a reflective upper surface sensor 52. Each sensor will be schematically described below.

The sheet presence/absence sensor 50 is a sensor for detecting whether or not at least one sheet is supported on the discharge tray 37. The sheet presence/absence sensor 50 includes a flag member 50*a* projecting upward from a center portion in the sheet width direction W of the upper surface of the discharge tray 37 serving as a sheet supporting surface, and a photo-interrupter that is shielded from light by the flag member 50*a*. When a sheet is supported on the discharge tray 37, the flag member 50*a* is pressed by the sheet and swings, and the photo-interrupter is switched from a transmitting state to a shielded state. When no sheet is supported on the discharge tray 37, the flag member 50*a* projects upward from the discharge tray 37, and the photo-interrupter takes the transmitting state. As a result of this, a signal corresponding to the presence or absence of a sheet on the discharge tray 37 is output.

The upper limit sensor 53 is a sensor that detects the discharge tray 37 being at an upper limit position in a lifting/lowering range thereof in the up-down direction V.

The lower limit sensor 54 is a sensor that detects the discharge tray 37 being at a lower limit position in the lifting/lowering range thereof in the up-down direction V. As the upper limit sensor 53 and the lower limit sensor 54, photo-interrupters shielded from light by a light shielding portion provided on the discharge tray 37 may be used. When the discharge tray 37 moves to the upper limit position or the lower limit position, the corresponding one of the photo-interrupters switches from the transmitting state to the shielded state. When the discharge tray 37 is positioned between the upper limit position and the lower limit position, the photo-interrupters are both in the transmitting state. As a result of this, the upper limit sensor 53 outputs a signal corresponding to whether or not the discharge tray 37 is at the upper limit position, and the lower limit sensor 54 outputs a signal corresponding to whether or not the discharge tray 37 is at the lower limit position.

The transmissive upper surface sensor 51 is provided below the bundle discharge rollers 36 in the up-down direction V. The transmissive upper surface sensor 51 is a photoelectric transmissive sensor constituted by a light emitting portion 51*a* serving as a first light emitting portion and a light receiving portion 51*b* serving as a first light receiving portion, and the light emitting portion 51*a* and the light receiving portion 51*b* oppose each other in a space above the discharge tray 37. The light receiving portion 51*b* is disposed on an optical axis L51 of light emitted from the light emitting portion 51*a*. The direction of the optical axis L51 is preferably parallel to the sheet width direction W. In this case, the light emitted from the light emitting portion 51*a* reaches the light receiving portion 51*b* by passing through a space above the discharge tray 37 in the sheet width direction W.

In the case where no sheet is present on the optical axis L51, the light emitted from the light emitting portion 51*a* reaches the light receiving portion 51*b*, and the light receiving portion 51*b* outputs an output signal such as a voltage value corresponding to the amount of received light. In the case where a sheet is present on the optical axis L51, the light emitted from the light emitting portion 51*a* is blocked by the sheet, thus the amount of light received by the light receiving portion 51*b* decreases, and the output signal of the light receiving portion 51*b* changes. As a result of this, the transmissive upper surface sensor 51 outputs an output signal serving as a detection signal corresponding to the position of the upper surface of the sheet supported on the discharge tray 37.

The reflective upper surface sensor 52 is provided below the bundle discharge rollers 36 in the up-down direction V. The reflective upper surface sensor 52 is a photoelectric reflective sensor constituted by a light emitting portion 52*a* serving as a second light emitting portion and a light receiving portion 52*b* serving as a second light receiving portion that are disposed on a substrate, and is disposed on the upstream side of the discharge tray 37 in the sheet discharging direction D. The direction of an optical axis L52 of the light emitted from the light emitting portion 52*a* preferably intersects with the direction of the optical axis L51 of the transmissive upper surface sensor 51. More preferably, the direction of the optical axis L52 is a direction along the sheet discharging direction D, that is, a direction toward the downstream side in the sheet discharging direction D. The light receiving portion 52*b* is capable of detecting light incident from the downstream side in the sheet discharging direction D.

In the case where a sheet is present on the optical axis L52, the light emitted from the light emitting portion 52*a* and then reflected by the sheet is incident on the light receiving portion 52*b*, and thus the light receiving portion 52*b* outputs an output signal such as a voltage value corresponding to the amount of light received by the light receiving portion 52*b*. In the case where no sheet is present on the optical axis L52, the light emitted from the light emitting portion 52*a* is not reflected by a sheet, thus the amount of light received by the light receiving portion 52*b* decreases as compared with the case where a sheet is present on the optical axis L52, and the output signal of the light receiving portion 51*b* changes. As a result of this, the reflective upper surface sensor 52 outputs an output signal serving as a detection signal corresponding to the position of the upper surface of the sheet supported on the discharge tray 37.

The light emitting portions 51*a* and 52*a* of the transmissive upper surface sensor 51 and the reflective upper surface sensor 52 are each constituted by, for example, a light emitting diode: LED, and the light receiving portions 51*b* and 52*b* are each constituted by, for example, a phototransistor. In addition, the "light" that the transmissive upper surface sensor 51 and the reflective upper surface sensor 52 use for detection of a sheet in the present embodiment may be infrared light.

Figure 4:
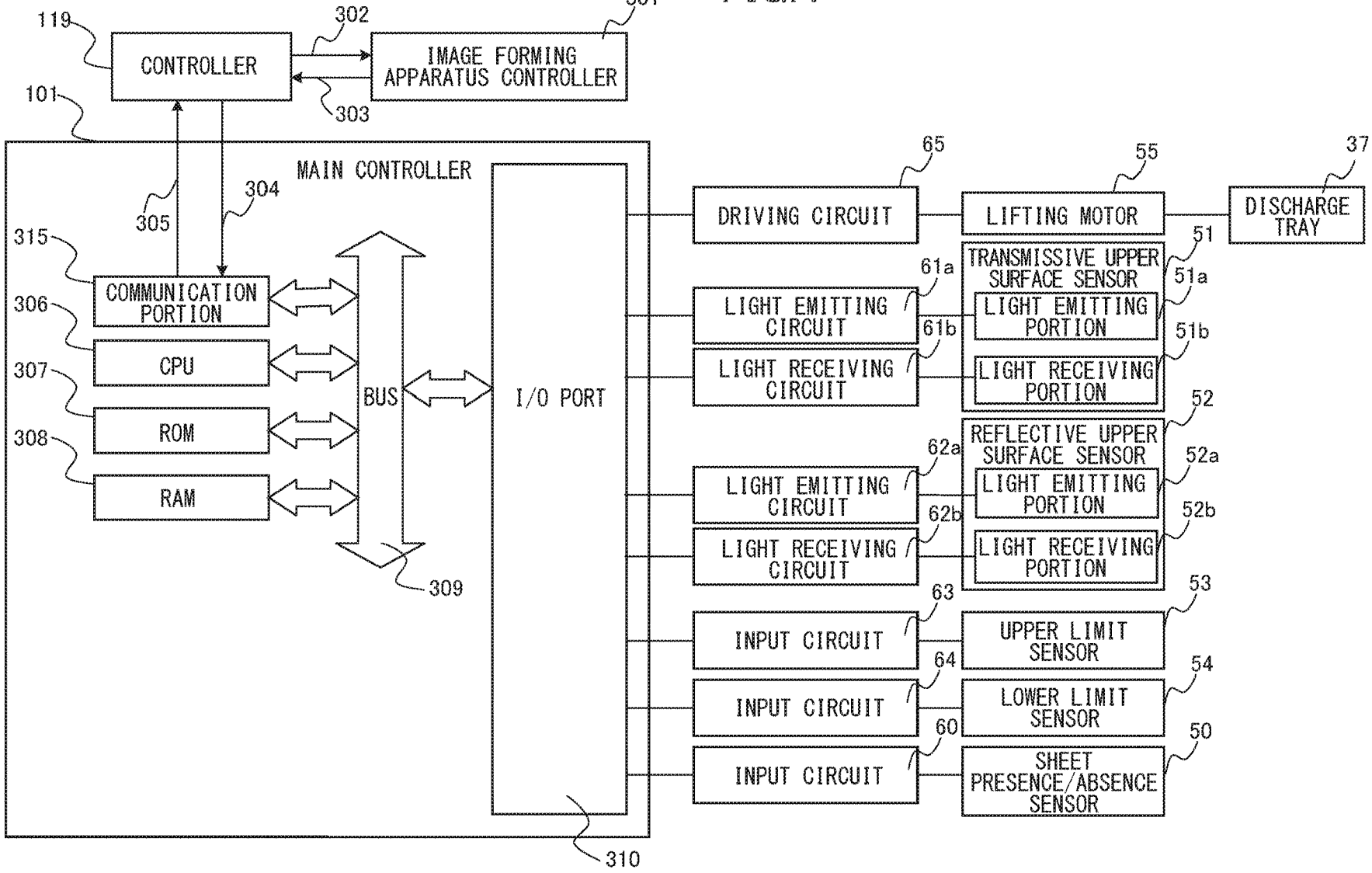
FIG. 4 is a diagram illustrating a hardware configuration of an image forming system according to the first embodiment.

The discharge tray 37 ascends and descends in a direction along the up-down direction V by being driven by a lifting motor 55 illustrated in FIG. 4 serving as a lifting portion. At this time, as will be described later, a lifting controller 80 illustrated in FIG. 5 controls the lifting motor 55 on the basis of output signals of the sensors 50 to 54 described above, and thus the lifting/lowering control of the discharge tray 37 is performed.

Specific examples of a mechanism for driving the discharge tray 37 by the driving force of the lifting motor 55 include the following. The sheet supporting surface of the discharge tray 37 is supported by a stay supported by the casing of the sheet processing apparatus 4, and this stay is slidable in the up-down direction V along a rail fixed to the casing and extending in the up-down direction V. In addition, the stay is coupled to a belt stretched in the up-down direction V by a driving pulley connected to the lifting motor 55 and another pulley. When the lifting motor 55 rotates in a normal direction or a reverse direction, the belt is rotated via the driving pulley, and thus the discharge tray 37 ascends or descends in accordance with the amount of rotation of the lifting motor 55.

Figure 3A:
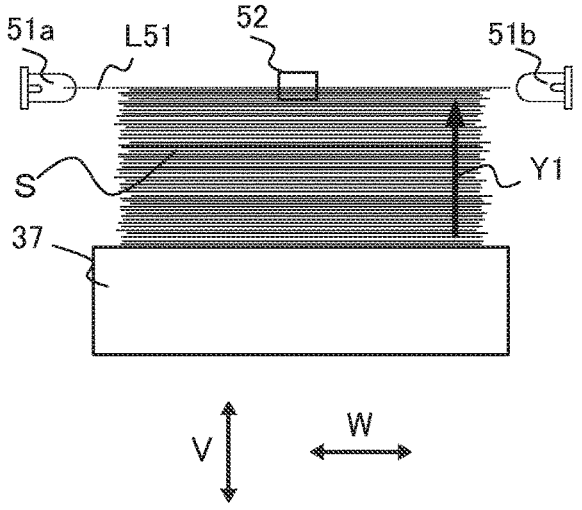
FIGS. 3A to 3D are each a diagram for describing a transmissive upper surface sensor or a reflective upper surface sensor according to the first embodiment.
Figure 3B:
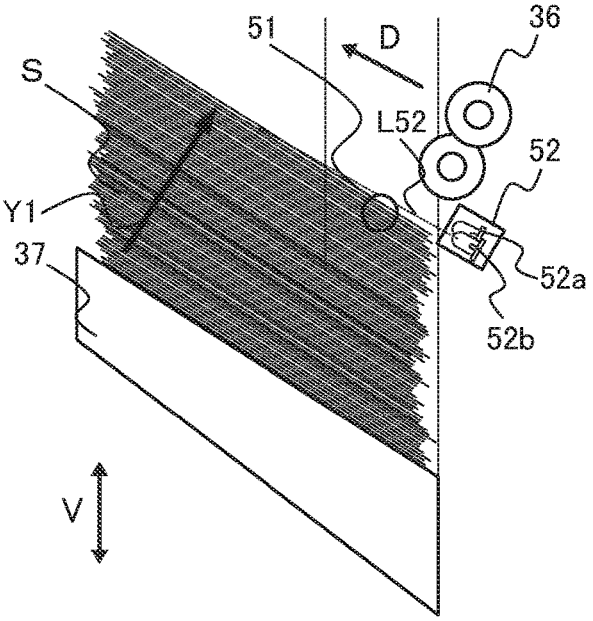

The function of the transmissive upper surface sensor 51 and the reflective upper surface sensor 52 will be further described with reference to FIGS. 3A to 3D. FIG. 3A is a schematic view of the sheet discharging portion 100 as viewed from the downstream side in the sheet discharging direction D. FIG. 3B is a schematic view of the sheet discharging portion 100 in the state of FIG. 3A as viewed in the sheet width direction W. The optical axis L51 of the transmissive upper surface sensor 51 is disposed slightly below the optical axis L52 of the reflective upper surface sensor 52 in a direction Y1, that is, a normal direction of the sheet supporting surface of the discharge tray 37 in which sheets S are stacked on the discharge tray 37. In the present embodiment, in design, the optical axis L51 of the transmissive upper surface sensor 51 is positioned 3 mm below the optical axis L52 of the reflective upper surface sensor 52. Therefore, in the case where the sheets S are stacked approximately flat without occurrence of curling or leaning described below, the transmissive upper surface sensor 51 detects the sheets S first. In the case where only one reflective upper surface sensor 52 is provided, the reflective upper surface sensor 52 is preferably disposed in a central region in the sheet width direction W to secure detection precision even with the curling and leaning of the sheets. The central region is a region at the center in the case where a region from the light emitting portion 51*a* to the light receiving portion 51*b* of the transmissive upper surface sensor 51 is equally divided into three regions in the sheet width direction W.

Figure 3C:
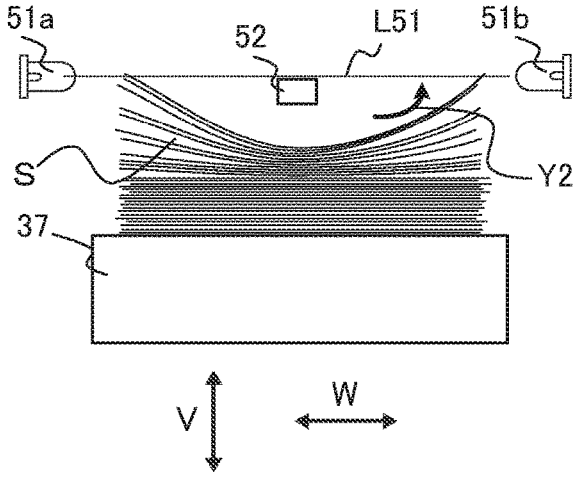

FIG. 3C is a diagram illustrating the sheet discharging portion 100 as viewed from the same viewpoint as in FIG. 3A, and illustrates a state in which curling indicated by an arrow Y2 is generated in the sheets S supported on the discharge tray 37. The position of the discharge tray 37 is the same as in FIG. 3A. The curling mentioned herein refers to a state in which at least one end portion of the sheets S in the sheet width direction W is lifted as compared with the center portion of the sheets S in the sheet width direction W, or a state in which the center portion is lifted as compared with the end portions in the sheet width direction W. In the state in which curling is generated in the sheets S, the signal level of the light receiving portion 51*b* of the transmissive upper surface sensor 51 changes when an end portion of the curled sheets S blocks the optical axis L51.

Figure 3D:
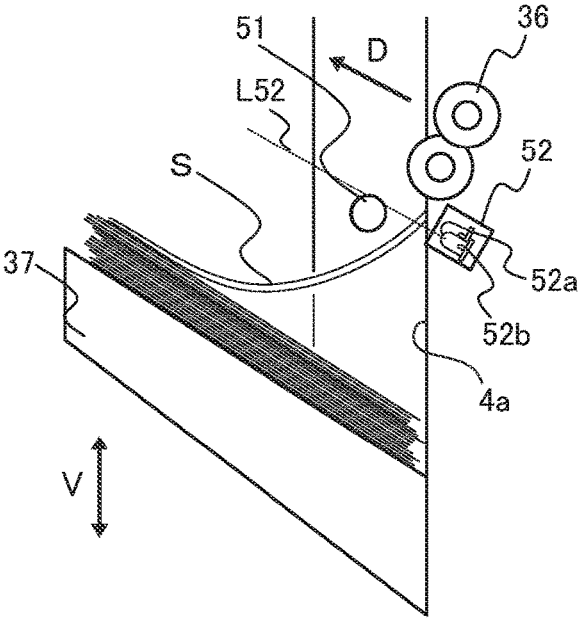

FIG. 3D is a diagram illustrating the sheet discharging portion 100 as viewed from the same viewpoint as in FIG. 3B, and illustrates a state in which the sheets S supported on the discharge tray 37 are leaning on a wall surface 4*a* of the sheet processing apparatus 4. The position of the discharge tray 37 is the same as in FIG. 3B. The trailing end, that is, the upstream end in the sheet discharging direction D of the sheets S supported on the discharge tray 37 abut the wall surface 4*a* due to the inclination of the discharge tray 37 inclined upward toward the downstream side in the sheet discharging direction D, and thus the wall surface 4*a* serves as an alignment standard for the sheets S in the sheet discharging direction D. The leaning of the sheet S refers to a state in which the trailing end of a newly discharged sheet S comes into contact with the wall surface 4*a* before landing on the sheet supporting surface of the discharge tray 37 or on the upper surface of an already supported sheet, thus the trailing end is held by the wall surface 4*a* by leaning on the wall surface 4*a* and has not landed on the supporting surface or on the upper surface of a sheet. In the case where the leaning of the sheet S occurs, the signal level of the light receiving portion 52*b* of the reflective upper surface sensor 52 changes when the leaning sheet S blocks the optical axis L52.

As described above, the transmissive upper surface sensor 51 and the reflective upper surface sensor 52, while both having a function of detecting the position of the upper surface of the sheets S, have different detection characteristics with respect to the shape and orientation of the sheets S supported on the discharge tray 37. By using sensors of different detection characteristics in combination, the lifting/lowering control of the discharge tray 37 can be performed appropriately. That is, in the present embodiment, in the case where both the transmissive upper surface sensor 51 and the reflective upper surface sensor 52 are capable of detecting a sheet, the two sensors can be used in combination and thus the detection results thereof can be complemented by each other. For example, in the case of detecting the upper surface position of the sheets S by only the transmissive upper surface sensor 51, there is a possibility that the output signal of the transmissive upper surface sensor 51 indicates that there is no sheet on the optical axis L51 although actually a leaning sheet covers a nip portion of the bundle discharge rollers 36. In this case, there is a possibility that the leaning sheet hinders discharge of a new sheet and discharge failure of a sheet or droppage of a sheet from the discharge tray 37 occurs. Similarly, also in the case of detecting the upper surface position of the sheets S by only the reflective upper surface sensor 52, there is a possibility that a curled sheet hinders discharge of a new sheet and discharge failure of a sheet or droppage of a sheet from the discharge tray 37 occurs. In contrast, by performing the lifting/lowering control of the discharge tray 37 while monitoring the upper surface position of the sheets S while using the transmissive upper surface sensor 51 and the reflective upper surface sensor 52 in combination, the possibility of occurrence of the issues described above can be lowered.

Hardware Configuration

FIG. 4 is a block diagram illustrating a hardware configuration of the image forming system 1S according to the present embodiment. As illustrated in FIG. 4, the image forming system 1S includes a main controller 101 of the sheet processing apparatus 4, a controller 119, and an image forming apparatus controller 301. The controller 119 performs overall control of the image forming apparatus 1 and the sheet processing apparatus 4. The image forming apparatus controller 301 controls the image forming apparatus 1. The main controller 101 controls the sheet processing apparatus 4.

The controller 119 is connected to the image forming apparatus controller 301 and the main controller 101 respectively via transmission signal lines 302 and 304, and transmits commands and data to the image forming apparatus controller 301 and the main controller 101 by serial communication. The image forming apparatus controller 301 is connected to the controller 119 via a transmission signal line 303, and transmits data to the controller 119 by serial communication. The main controller 101 of the sheet processing apparatus 4 is connected to the controller 119 via a transmission signal line 305, and transmits data to the controller 119 by serial communication. When performing an image forming operation, the controller 119 transmits a command to the image forming apparatus controller 301 and the main controller 101, and receives data from the image forming apparatus controller 301 and the main controller 101. As described above, in the case where a plurality of apparatuses are connected to and cooperate with each other, the controller 119 integrally manages the control and status of each apparatus, and thus maintains the consistency of operation between the apparatuses.

The main controller 101 of the sheet processing apparatus 4 serving as a controller according to the present embodiment includes a central processing unit: CPU 306, a random access memory: RAM 308, a read-only memory: ROM 307, a communication portion 315, and an I/O port 310. The CPU 306 is a central processing unit that controls various operations of the sheet processing apparatus 4. The RAM 308 is a volatile memory that temporarily stores control data required for operation of the sheet processing apparatus 4. The ROM 307 is a nonvolatile memory that stores a control program for the sheet processing apparatus 4, and a control table required for the operation of the sheet processing apparatus 4. The communication portion 315 communicates with the controller 119.

The CPU 306, the RAM 308, the ROM 307, and the communication portion 315 are connected to the I/O port 310 via a bus 309, and the I/O port 310 is connected to each constituting element of the sheet processing apparatus 4. That is, via the I/O port 310, the main controller 101 outputs control signals for operating various actuators of the sheet processing apparatus 4, and receives input of detection signals from various sensors of the sheet processing apparatus 4.

More specifically, the main controller 101 is connected to the lifting motor 55 via a driving circuit (i.e., lifting motor driving circuit) 65. In the present embodiment, a stepping motor is used as the lifting motor 55. The lifting motor 55 is connected to a lifting mechanism of the discharge tray 37 via an unillustrated drive transmission mechanism such as gears. The discharge tray 37 ascends when the lifting motor 55 rotates in a first direction, and descends when the lifting motor 55 rotates in a second direction opposite to the first direction. The discharge tray 37 ascends or descends by a predetermined distance, for example, 0.01 mm, in accordance with a 1-step rotation operation of the lifting motor 55.

In addition, the main controller 101 is connected to the light emitting portion 51*a* and the light receiving portion 51*b* of the transmissive upper surface sensor 51 respectively via a light emitting circuit 61*a* and a light receiving circuit 61*b*, and is connected to the light emitting portion 52*a* and the light receiving portion 52*b* of the reflective upper surface sensor 52 respectively via a light emitting circuit 62*a* and a light receiving circuit 62*b*. The light receiving portion 51*b* of the transmissive upper surface sensor 51 and the light receiving portion 52*b* of the reflective upper surface sensor 52 input low-level signals to the main controller 101 via the light receiving circuits 61*b* and 62*b* in the case where the light receiving portions 51*b* and 52*b* are not receiving light, and input high-level signals to the main controller 101 in the case where the light receiving portions 51*b* and 52*b* are receiving light. Further, the main controller 101 is connected to the upper limit sensor 53, the lower limit sensor 54, and the sheet presence/absence sensor 50 respectively via input circuits 63, 64, and 60, and receive signals output from the sensors.

Functional Configuration

Figure 5:
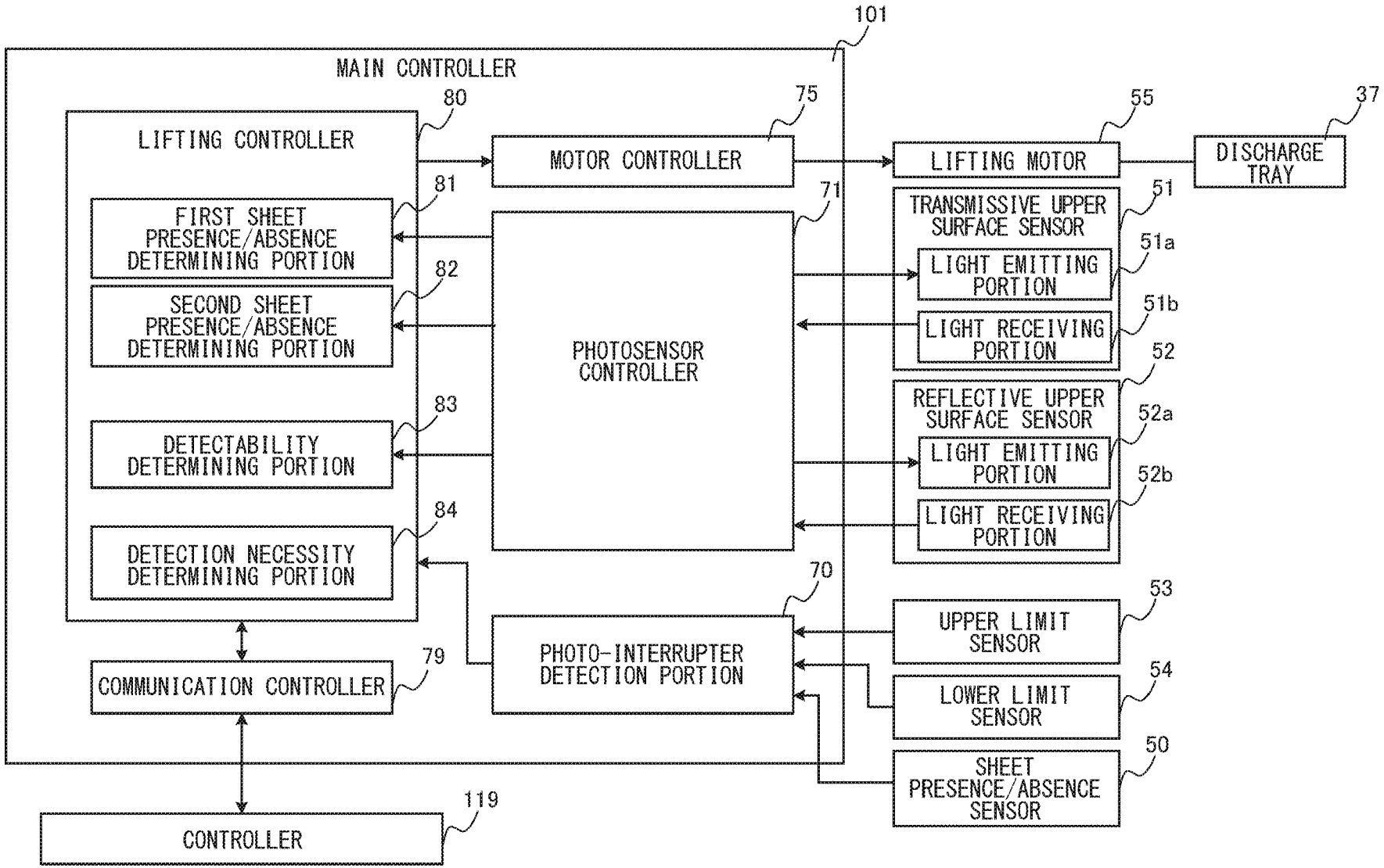
FIG. 5 is a functional block diagram of the image forming system according to the first embodiment.

FIG. 5 is a block diagram illustrating a functional configuration of the image forming system 1S. The main controller 101 is constituted by a motor controller 75, a photosensor controller 71, a photo-interrupter detection portion 70, a lifting controller 80, and a communication controller 79.

The motor controller 75 controls the lifting motor 55 to rotate in the first direction, rotate in the second direction, or stop rotation, in accordance with a command from the lifting controller 80. In the case where a driving step number of the lifting motor 55 that is a stepping motor is specified, the motor controller 75 controls the lifting motor 55 to rotate in a specified direction by the specified number of steps. The photosensor controller 71 performs control to repeatedly turn on and off the light emitting portion 51*a* of the transmissive upper surface sensor 51 and the light emitting portion 52*a* of the reflective upper surface sensor 52. In addition, the photosensor controller 71 obtains signal levels of the light receiving portions 51*b* and 52*b* when the light emitting portions 51*a* and 52*a* are on, and signal levels of the light receiving portions 51*b* and 52*b* when the light emitting portions 51*a* and 52*a* are off. In the configuration example of the present embodiment, the light emitting portions 51*a* and 52*a* are repeatedly turned on and off at a period of 50 milliseconds.

The photo-interrupter detection portion 70 detects the position of the discharge tray 37 and the presence or absence of a sheet on the discharge tray 37 on the basis of signals obtained from the photo-interrupters of the upper limit sensor 53, the lower limit sensor 54, and the sheet presence/absence sensor 50. Specifically, the photo-interrupter detection portion 70 detects the discharge tray 37 being at the upper limit position on the basis of the upper limit sensor 53 being in the shielded state, and detects the discharge tray 37 being at the lower limit position on the basis of the lower limit sensor 54 being in the shielded state. In addition, the photo-interrupter detection portion 70 detects the presence of a sheet on the discharge tray 37 on the basis of the photo-interrupter of the sheet presence/absence sensor 50 being in the shielded state.

The communication controller 79 controls communication with the controller 119 described above. The lifting controller 80 obtains information about a sheet to be discharged onto the discharge tray 37 via communication with the controller 119. Examples of the information about the sheet include the type of the sheet, the grammage of the sheet, the grain direction of the sheet, that is, the direction of fiber of the sheet, information about a surface of the sheet on which printing is to be performed, that is, which of simplex printing and duplex printing is to be performed, the size of the sheet, the number of sheets, the type of processing to be performed on the sheet, the temperature and humidity of the environment in which the sheet is placed, and so forth.

The lifting controller 80 includes a first sheet presence/absence determining portion 81 that determines whether or not a sheet is present on the basis of the output signal of the transmissive upper surface sensor 51, and a second sheet presence/absence determining portion 82 that determines whether or not a sheet is present on the basis of the output signal of the reflective upper surface sensor 52. The lifting controller 80 further includes a detectability determining portion 83 that determines whether or not sheet detection by the transmissive upper surface sensor 51 is possible, and a detection necessity determining portion 84 that determines whether or not sheet detection by the transmissive upper surface sensor 51 is needed. The lifting controller 80 performs lifting/lowering control of the discharge tray 37 by commanding the motor controller 75 to drive the lifting motor 55 on the basis of the information obtained from the photosensor controller 71, the photo-interrupter detection portion 70, and the communication controller 79.

The first sheet presence/absence determining portion 81 determines whether or not a sheet is present on the optical axis L51 of the transmissive upper surface sensor 51 on the basis of the information obtained from the photosensor controller 71. Specifically, whether or not a sheet is present is determined by using the signal level of the light receiving portion 51*b* of the transmissive upper surface sensor 51 when the light emitting portion 51*a* is on, on the basis of a relationship shown in Table 1. To be noted, "Low" in Table 1 indicates a signal level corresponding to a state in which the amount of light received by the light receiving portion 51*b* is a first amount smaller than a predetermined standard, and "High" in Table 1 indicates a signal level corresponding to a state in which the amount of light received by the light receiving portion 51*b* is a second amount larger than the predetermined standard.

TABLE 1

| SIGNAL LEVEL OF LIGHT RECEIVING PORTION OF TRANSMISSIVE UPPER SURFACE SENSOR WHEN LIGHT EMITTING PORTION IS ON | DETERMINATION OF PRESENCE/ ABSENCE OF SHEET |
|---|---|
| LOW | PRESENT |
| HIGH | ABSENT |

The second sheet presence/absence determining portion 82 determines whether or not a sheet is present on the optical axis L52 of the reflective upper surface sensor 52 on the basis of the information obtained from the photosensor controller 71. Specifically, whether or not a sheet is present is determined by using the signal levels of the light receiving portion 52*b* of the reflective upper surface sensor 52 when the light emitting portion 52*a* is on and off, on the basis of a relationship shown in Table 2. To be noted, "Low" in Table 2 indicates a signal level corresponding to a state in which the amount of light received by the light receiving portion 52*b* is smaller than a predetermined standard, and "High" in Table 2 indicates a signal level corresponding to a state in which the amount of light received by the light receiving portion 52*b* is larger than the predetermined standard.

TABLE 2

| SIGNAL LEVEL OF LIGHT RECEIVING PORTION OF REFLECTIVE UPPER SURFACE SENSOR | | |
|---|---|---|
| WHTN LIGHT EMITTING PORTION IS OFF | WHTN LIGHT EMITTING PORTION IS ON | DETERMINATION OF PRESENCE/ ABSENCE OF SHEET |
| LOW | LOW | ABSENT |
| LOW | HIGH | PRESENT |
| HIGH | LOW | ABSENT |
| HIGH | HIGH | ABSENT |

The detectability determining portion 83 serving as a first determining portion according to the present embodiment determines, on the basis of the information obtained from the photosensor controller 71, whether or not sheet detection by using the transmissive upper surface sensor 51 is possible. "Whether or not sheet detection by using the transmissive upper surface sensor 51 is possible" indicates whether or not it is appropriate or applicable to detect the presence or absence of a sheet on the optical axis L51 by using the transmissive upper surface sensor 51. Specifically, whether or not sheet detection by the transmissive upper surface sensor 51 is possible is determined by using the signal level of the light receiving portion 51*b* of the transmissive upper surface sensor 51 when the light emitting portion 51*a* is off, on the basis of a relationship shown in Table 3. In other words, in the case where the amount of light received by the first light receiving portion when the first light emitting portion is off is smaller than the predetermined standard, the first determining portion determines that sheet detection by the transmissive sensor is possible, and in the case where the amount of light received by the first light receiving portion when the first light emitting portion is off is larger than the predetermined standard, the first determining portion determines that sheet detection by the transmissive sensor is impossible.

TABLE 3

| SIGNAL LEVEL OF LIGHT RECEIVING PORTION OF TRANSMISSIVE UPPER SURFACE SENSOR WHEN LIGHT EMITTING PORTION IS OFF | DETERMINATION OF WHETHER SHEET DETECTION BY TRANSMISSIVE UPPER SURFACE SENSOR IS POSSIBLE |
|---|---|
| LOW | POSSIBLE |
| HIGH | IMPOSSIBLE |

The detection necessity determining portion 84 serving as a second determining portion according to the present embodiment determines, by using information about a sheet received from the controller 119, whether or not sheet detection by the transmissive upper surface sensor 51 is needed. "Whether or not detection of a sheet is needed" indicates whether or not detection of presence or absence of a sheet on the optical axis L51 by the transmissive upper surface sensor 51 is needed. Specifically, necessity of sheet detection by the transmissive upper surface sensor 51 is determined by using the information about a sheet received from the controller 119 on the basis of a relationship shown in Table 4.

TABLE 4

| SHEET-INSTALLED ENVIRONMENT (RELATIVE HUMIDITY [RH %]) | GRAMMAGE [g/m$^2$] | DETERMINATION OF WHETHER OR NOT DETECTION OF BY TRANSMISSIVE UPPER SURFACE SENSOR IS NEEDED |
|---|---|---|
| 0 to 75 | 50 to 59 | NEEDED |
| | 60 to 74 | NEEDED |
| | 75 to 90 | NOT NEEDED |
| | 91 to 130 | NOT NEEDED |
| | 131 to 300 | NOT NEEDED |
| 76 to 100 | 50 to 59 | NEEDED |
| | 60 to 74 | NEEDED |
| | 75 to 90 | NEEDED |
| | 91 to 130 | NOT NEEDED |
| | 131 to 300 | NOT NEEDED |

In other words, the second determining portion, (i) if a grammage of the sheet discharged by the discharging portion is a first grammage, determines that detection of the sheet by the transmissive sensor is not needed, (ii) if an environmental humidity in which the sheet discharging apparatus is disposed is a first humidity, determines that sheet detection by the transmissive sensor is not needed, and (iii) if the grammage of the sheet discharged by the discharging portion is a second grammage smaller than the first grammage and the environmental humidity is a second humidity higher than the first humidity, determines that sheet detection by the transmissive sensor is needed. In the present embodiment, for example, the "first grammage" is 100 g/m$^2$, the "second grammage" is 80 g/m$^2$, the "first humidity" is 50 RH %, and the "second humidity" is 90 RH %. That is, in the case where the grammage of the sheet is smaller than a predetermined standard and the humidity is higher than a predetermined standard, the second determining portion determines that sheet detection by the transmissive upper surface sensor 51 is needed because there is a risk of occurrence of curling described below, and otherwise determines that sheet detection by the transmissive upper surface sensor 51 is not necessarily needed.

As described above with reference to FIG. 3C, the transmissive upper surface sensor 51 is configured to be capable of detecting an end portion of a sheet that is lifted up by curling in the case of a curled sheet. To lower the possibility of a discharge failure or the like caused by curling of a sheet, it is preferable that the lifting/lowering control of the discharge tray 37 is performed by using the transmissive upper surface sensor 51 in a situation in which occurrence of curling in the sheet is expected.

The curling of the sheet is known to be more likely to occur in the case where the degree of moisture absorption of the sheet to be used for image formation is higher and where the grammage of the sheet is smaller. Therefore, in the present embodiment, as predetermined conditions indicating that the possibility of occurrence of curling is high, the relative humidity [RH %] of the sheet-installed environment and the grammage [g/m$^2$] of the sheet shown in Table 4 are used among information about the sheet. The "sheet-installed environment" refers to an environment in which a sheet to be used for image formation has been placed, specifically in the present embodiment, the environment in the storage chamber of the feeding apparatus 6 of the image forming apparatus 1 in which the sheet is accommodated. The relative humidity of the sheet-installed environment can be obtained as a detection result of the humidity sensor 120 included in the image forming apparatus 1 by communication via the controller 119.

To be noted, a humidity sensor that detects the relative humidity of the environment in which the image forming system 1S may be provided in the sheet processing apparatus 4, and the detection result thereof may be referred to. In addition, the determination of whether or not sheet detection by the transmissive upper surface sensor 51 is needed may be made on the basis of the information about the sheet to be discharged, in accordance with conditions different from the conditions shown in Table 4. For example, at least one of the type of the sheet, the grain direction of the sheet, information indicating the surface of the sheet on which printing is to be performed, the size of the sheet, the number of sheets, the type of processing performed on the sheet, and the temperature of the sheet-installed environment may be used. Examples of the type of the sheet include thin paper sheets, plain paper sheets, and cardboards, and examples of the type of processing performed on the sheet include stapling. These conditions are appropriately used in combination in accordance with whether or not the condition is correlated with the likelihood of occurrence of curling of a sheet. For example, a configuration in which only the information about the grammage is used may be employed such that in the case where the grammage of the sheet to be discharged by the discharging portion is a first grammage, the second determining portion determines that sheet detection by the transmissive sensor is not needed, and in the case where the grammage of the sheet to be discharged by the discharging portion is a second grammage smaller than the first grammage, the second determining portion determines that detection of the sheet by the transmissive sensor is needed. For another example, a configuration in which only the information about the humidity is used may be employed such that in the case where the humidity of the environment in which the sheet discharging apparatus is installed is a first humidity, the second determining portion determines that sheet detection by the reflective sensor is not needed, and in the case where the humidity is a second humidity higher than the first humidity, the second determining portion determines that detection of the sheet by the transmissive sensor is needed.

Lifting/Lowering Control of Discharge Tray

Next, the lifting/lowering control of the discharge tray 37 by the main controller 101 according to the present embodiment will be described. After the power of the sheet processing apparatus 4 is turned on, the main controller 101 continues monitoring whether there is a job of an image forming operation in which the discharge tray 37 is set as a sheet discharge destination, and in the case where the job is executed, the main controller 101 performs the lifting/lowering control of the discharge tray 37. In the lifting/lowering control, the discharge tray 37 is moved to the upper limit position in the case where no sheet is present on the discharge tray 37, and in the case where a sheet is supported on the discharge tray 37, the discharge tray 37 is lowered in accordance with the amount of sheets supported thereon such that the upper surface of the sheets on the discharge tray 37 is at a predetermined position.

Figure 6:
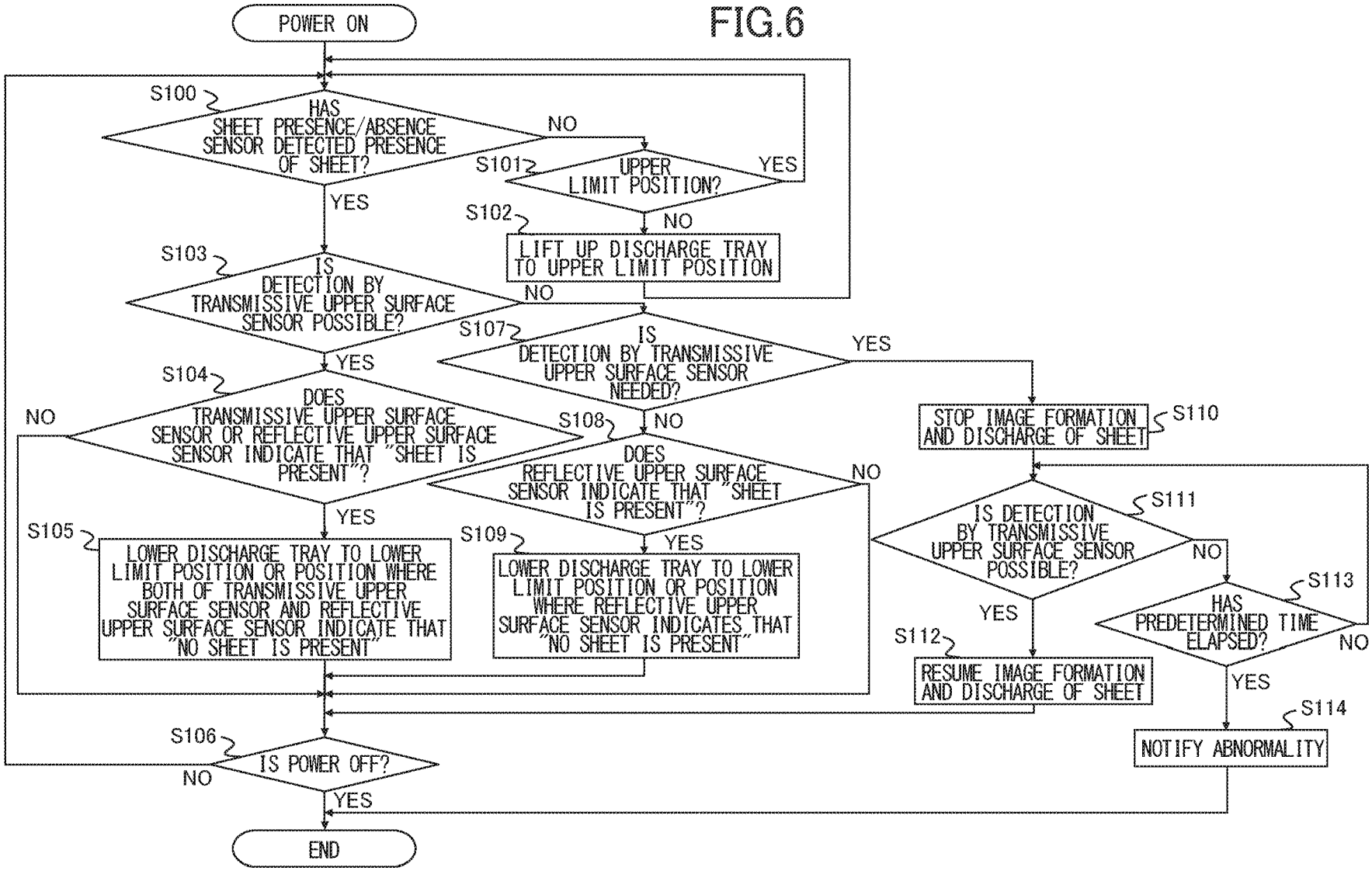
FIG. 6 is a flowchart of lifting/lowering control of a discharge tray according to the first embodiment.

The lifting/lowering control of the discharge tray 37 will be described in detail with reference to a flowchart of FIG. 6. First, in step S100, the lifting controller 80 determines whether or not a sheet is present on the discharge tray 37 on the basis of the output signal of the sheet presence/absence sensor 50. In the case where it has been determined that no sheet is present on the discharge tray 37, the lifting controller 80 determines in step S101 whether or not the discharge tray 37 is at the upper limit position on the basis of the detection result of the upper limit sensor 53. In the case where it has been determined that the discharge tray 37 is at the upper limit position, the process returns to step S100, and the lifting controller 80 stands by until the output signal of the sheet presence/absence sensor 50 indicates that a sheet is present on the discharge tray 37. In the case where it has been determined that the discharge tray 37 is not at the upper limit position in step S101, the lifting controller 80 rotates the lifting motor 55 in the first direction via the motor controller 75, and thus lifts up the discharge tray 37. Then, when the lifting controller 80 confirms that the detection result of the upper limit sensor 53 indicates that the discharge tray 37 is at the upper limit position, the lifting controller 80 stops the ascent of the discharge tray 37 in step S102.

According to the process described above, in the case where no sheet is present on the discharge tray 37, the discharge tray 37 stands by at the upper limit position.

In the case where it has been determined that a sheet is present on the discharge tray 37 in step S100, the detectability determining portion 83 determines in step S103 whether or not sheet detection by the transmissive upper surface sensor 51 is possible. In the case where it has been determined that sheet detection by the transmissive upper surface sensor 51 is "possible", whether or not the transmissive upper surface sensor 51 and the reflective upper surface sensor 52 are detecting a sheet is determined in step S104 by the first sheet presence/absence determining portion 81 and the second sheet presence/absence determining portion 82 as shown in Tables 1 and 2. In the case where the detection result of the transmissive upper surface sensor 51 or the reflective upper surface sensor 52 indicates that "a sheet is present", in step S105, the lifting controller 80 rotates the lifting motor 55 in the second direction via the motor controller 75, and thus lowers the discharge tray 37. In other words, in the case where the transmissive sensor or the reflective sensor has output an output signal indicating that a sheet has been detected, the controller lowers the supporting portion by the lifting portion to a position where each of the transmissive sensor and the reflective sensor outputs an output signal indicating that no sheet is detected. Then, when the discharge tray 37 is lowered to a position where the detection results of both the transmissive upper surface sensor 51 and the reflective upper surface sensor 52 indicate that "no sheet is present", the lifting controller 80 stops the descent of the discharge tray 37. Alternatively, the lifting controller 80 stops the descent of the discharge tray 37 when the detection result of the lower limit sensor 54 indicates that the discharge tray 37 is at the lower limit position while lowering the discharge tray 37. In the case where the detection results of both the transmissive upper surface sensor 51 and the reflective upper surface sensor 52 indicate that "no sheet is present" in step S104, the lifting controller 80 proceeds to step S106 without lowering the discharge tray 37.

In the case where the detectability determining portion 83 has determined that sheet detection by the transmissive upper surface sensor 51 is "possible" according to the process described above, lifting/lowering control using both the transmissive upper surface sensor 51 and the reflective upper surface sensor 52 is performed. In other words, in the case where the amount of light received by the first light receiving portion in a state in which the first light emitting portion is not emitting light is a first amount corresponding to Low in Table 3, the supporting portion is lifted or lowered on the basis of the output signals of the transmissive sensor and the reflective sensor. In this case, more reliable lifting/lowering control in which discharge of sheets can be continued even in the case where curling or leaning has occurred can be performed by making most of the detection characteristics of the transmissive upper surface sensor 51 and the reflective upper surface sensor 52.

In the case where the detectability determining portion 83 has determined that sheet detection by the transmissive upper surface sensor 51 is impossible in step S103, the detection necessity determining portion 84 determines in step S107 whether or not sheet detection by the transmissive upper surface sensor 51 is needed. In the case where it has been determined that sheet detection by the transmissive upper surface sensor 51 is "not needed", the second sheet presence/absence determining portion 82 determines in step S108 whether or not the reflective upper surface sensor 52 is detecting a sheet. In the case where the detection result of the reflective upper surface sensor 52 indicates that "a sheet is present", in step S109, the lifting controller 80 rotates the lifting motor 55 in a second direction via the motor controller 75, and thus lowers the discharge tray 37. In other words, in the case where the reflective sensor has output an output signal indicating that a sheet has been detected, the controller lowers the supporting portion by the lifting portion to a position where the reflective sensor outputs an output signal indicating that a sheet is not detected. Then, when the discharge tray 37 is lowered to a position where the detection result of the reflective upper surface sensor 52 indicates that "no sheet is present", the lifting controller 80 stops the descent of the discharge tray 37. Alternatively, the lifting controller 80 stops the descent of the discharge tray 37 when the detection result of the lower limit sensor 54 indicates that the discharge tray 37 is at the lower limit position while lowering the discharge tray 37. In the case where the detection result of the reflective upper surface sensor 52 indicates that "no sheet is present" in step S108, the lifting controller 80 proceeds to step S106 without lowering the discharge tray 37.

According to the process described above, in the case where the detectability determining portion 83 has determined that sheet detection by the transmissive upper surface sensor 51 is "impossible", and the detection necessity determining portion 84 has determined that sheet detection by the transmissive upper surface sensor 51 is "not needed", the lifting/lowering control is performed by using the reflective upper surface sensor 52. In other words, in the case where the amount of light received by the first light receiving portion in a state in which the first light emitting portion is not emitting light is a second amount corresponding to High of Table 3 larger than the first amount, and the grammage of the sheet to be discharged by the discharging portion and the humidity of the environment in which the sheet has been placed do not satisfy predetermined conditions, which is a case corresponding to "Not needed" of Table 4, the supporting portion is lifted or lowered by the lifting portion on the basis of the output signal of the reflective sensor. In this case, although the transmissive upper surface sensor 51 is not used, since the likelihood of occurrence of curling of a sheet is low, appropriate lifting/lowering control can be performed by using the reflective upper surface sensor 52.

In the case where the detection necessity determining portion 84 has determined that sheet detection by the transmissive upper surface sensor 51 is "needed" in step S107, the communication controller 79 notifies the controller 119 of stoppage of image formation on a sheet to be discharged onto the discharge tray 37 in step S110. When the notification of stoppage of image formation is received, the controller 119 stops a new image formation instruction in which the discharge tray 37 is set as a discharge destination. However, a sheet being conveyed in the image forming apparatus 1 and the sheet processing apparatus 4 is discharged onto the upper discharge tray 25 or the lower discharge tray 37.

According to the process described above, in the case where the detectability determining portion 83 has determined that sheet detection by the transmissive upper surface sensor 51 is "impossible" and the detection necessity determining portion 84 has determined that sheet detection by the transmissive upper surface sensor 51 is "needed", sheet discharge onto the discharge tray 37 is stopped. In other words, in the case where the amount of light received by the first light receiving portion in a state in which the first light emitting portion is not emitting light is a second amount corresponding to High in Table 3 and the grammage of the sheet to be discharged by the discharging portion and the humidity of the environment in which the sheet has been placed satisfy predetermined conditions, which is a case corresponding to "needed" in Table 4, the supporting portion is lifted or lowered by the lifting portion in response to discharge of a sheet from the discharging portion. In this case, since there is a possibility that curling of the sheet occurs, it is determined that it is difficult to perform appropriate lifting/lowering control with just the reflective upper surface sensor 52, and therefore stoppage of sheet discharge, that is, stoppage of the image forming operation is determined.

Then, in step S111, a standby state is taken until the determination result of the detectability determining portion 83 indicates that sheet detection by the transmissive upper surface sensor 51 is "possible". During the standby state, in step S113, elapsed time from step S110 is measured. In the case where the elapsed time has reached a predetermined time Terr during the standby state, the communication controller 79 notifies the controller 119 of abnormality of the transmissive upper surface sensor 51 in step S114, and the lifting/lowering control of the discharge tray 37 is finished. When the determination result of the detectability determining portion changes to "possible" during the standby state, the communication controller 79 notifies the controller 119 of resuming image formation on the sheet to be discharged onto the discharge tray 37 in step S112. When the notification to resume the image formation is received, the controller 119 resumes the image formation instruction in which the discharge tray 37 is set as a discharge destination, and proceeds to step S106.

In step S106, the main controller 101 repeats the processing from step S100 up to this step until the power of the sheet processing apparatus 4 is turned off.

Advantages of Present Embodiment

There is a possibility that the light receiving portion 51*b* of the transmissive upper surface sensor 51 is affected by disturbance light from the outside due to the configuration thereof. For example, the light receiving portion 51*b* can be affected by sunlight. That is, sunlight can be incident on the light receiving portion 51*b* at an incident angle close to that of the optical axis L51 of the light emitted from the light emitting portion 51*a*, depending on conditions such as the direction in which the sheet processing apparatus 4 is installed, the weather, and the time. In addition, the amount of the sunlight incident on the light receiving portion 51*b* can be as large as or larger than the amount of light that is incident on the light receiving portion 51*b* after being emitted from the light emitting portion 51*a*.

In such a case, the amount of light received by the light receiving portion 51*b* is approximately saturated even when the light emitting portion 51*a* is off, and therefore the signal level of the light receiving portion 51*b* hardly changes even when the light emitting portion 51*a* is turned on. That is, the light receiving portion 51*b* outputs an approximately constant signal regardless of whether the light emitting portion 51*a* is on or off, and therefore it becomes inappropriate to determine whether or not a sheet is present on the optical axis L51 on the basis of the signal of the light receiving portion 51*b*.

In contrast, although disturbance light such as sunlight can be also incident on the reflective upper surface sensor 52, since the light emitting portion 52*a* and the light receiving portion 52*b* are disposed close to each other, in the case where a sheet is present on the optical axis L52 of the reflective upper surface sensor 52, the disturbance light is shielded by the sheet. Therefore, the second sheet presence/absence determining portion 82 can appropriately detect the presence or absence of a sheet on the optical axis L52 by determining whether or not a sheet is present by using the signal levels of the light receiving portion 52*b* of the reflective upper surface sensor 52 when the light emitting portion 52*a* is off and on in combination. That is, the reflective sensor is advantageous in that an appropriate detection accuracy can be more easily maintained than in the transmissive sensor in the presence of disturbance light.

In the present embodiment, in a configuration including the transmissive upper surface sensor 51 and the reflective upper surface sensor 52, the lifting/lowering control of the discharge tray 37 is performed while selectively determining which of the transmissive upper surface sensor 51 and the reflective upper surface sensor 52 is used in accordance with the situation. That is, the detectability determining portion 83 serving as a first determining portion determines whether or not detection of the upper surface of a sheet by the transmissive upper surface sensor 51 is possible, and the detection necessity determining portion 84 serving as a second determining portion determines whether or not detection of the upper surface of a sheet by the transmissive upper surface sensor 51 is needed. Then, whether to perform lifting/lowering control on the basis of the output signals of the transmissive upper surface sensor 51 and the reflective upper surface sensor 52, perform the lifting/lowering control on the basis of the output signal of just the reflective upper surface sensor 52, or stop the sheet discharge is determined. As a result of this, the sheet discharge can be continued as long as possible while lowering the possibility of erroneous operation caused by the influence of disturbance light or the like, with a simple configuration.

Although the predetermined time Teri described above is set to 1 hour as an example in the present embodiment on the basis of time in which the light receiving portion 51*b* can be affected by sunlight, the time Terr can be appropriately changed. In addition, when a notification of stoppage of image formation is received, the controller 119 may display, on an unillustrated operation panel, a screen indicating that the image forming operation is stopped due to disturbance light so as to prompt the user to take a measure to prevent the disturbance light from entering.

To be noted, as an alternative method for reducing the influence of disturbance light on the transmissive upper surface sensor 51, providing a plurality of transmissive upper surface sensors having different optical axis directions can be considered. However, in this configuration, a plurality of light emitting portions and a plurality of light receiving portions are disposed at positions apart from each other, and therefore the cost of the hardware increases. In addition, although disposing an aperture provided in front of the light receiving portion 51*b* at a position as away from the light receiving portion 51*b* as possible can be also considered, this leads to increase in the size of the apparatus. In contrast, according to the present embodiment, the influence of disturbance light can be reduced with a simple and compact configuration.

Second Embodiment

A sheet discharging portion according to a second embodiment will be described focusing on the difference from the first embodiment. The present embodiment is different in the details of the lifting/lowering control of the discharge tray 37. In the description below, it is assumed that elements denoted by the same reference signs as in the first embodiment have substantially the same configuration and effects as in the first embodiment.

Figure 7:
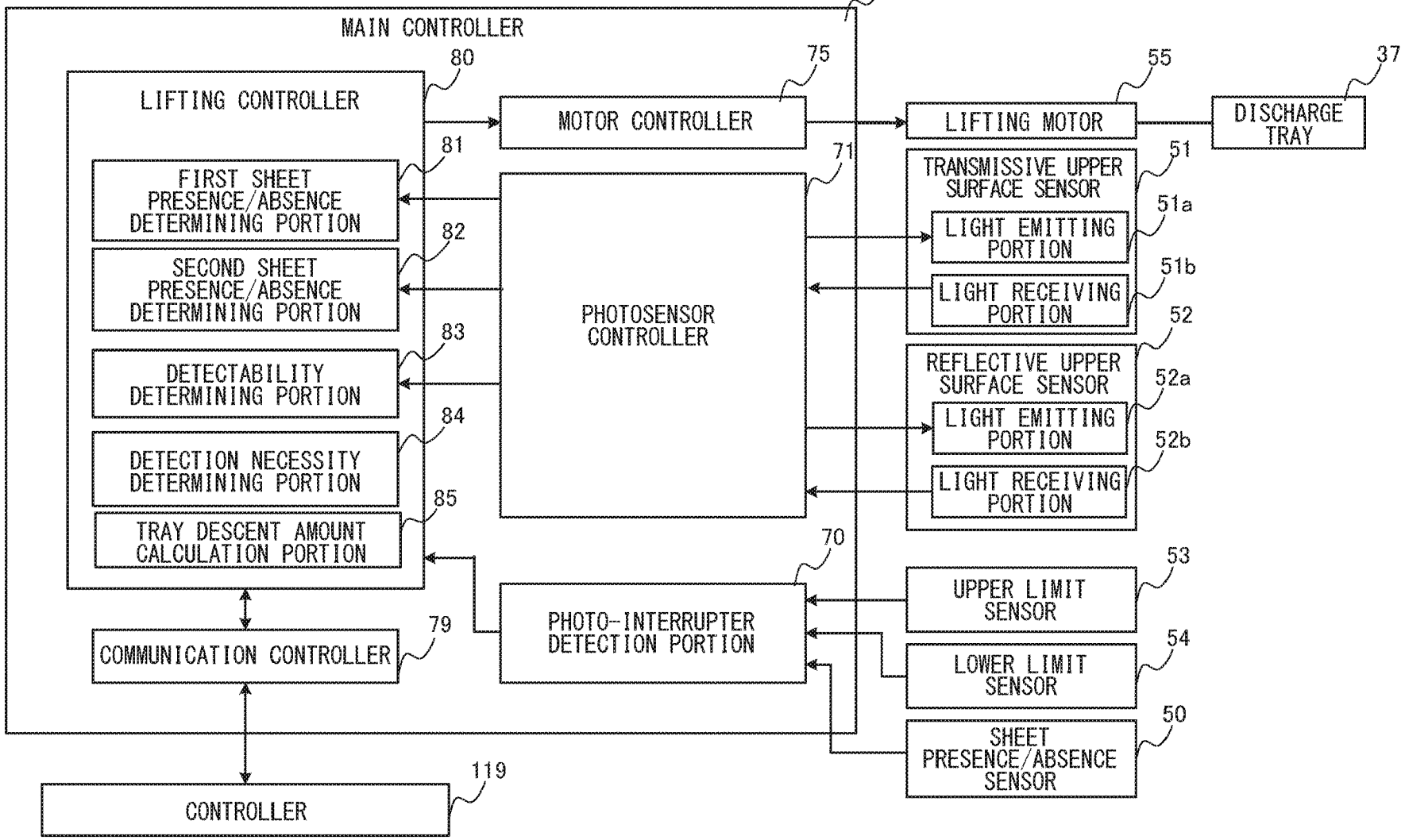
FIG. 7 is a functional block diagram of an image forming system according to a second embodiment.

FIG. 7 is a block diagram illustrating a functional configuration of an image forming system according to the present embodiment. The lifting controller 80 includes a tray descent amount calculation portion 85 in addition to the first sheet presence/absence determining portion 81, the second sheet presence/absence determining portion 82, the detectability determining portion 83, and the detection necessity determining portion 84. The tray descent amount calculation portion 85 calculates the descent amount of the discharge tray 37 on the basis of information about a sheet obtained by communication with the controller 119.

Figure 8:
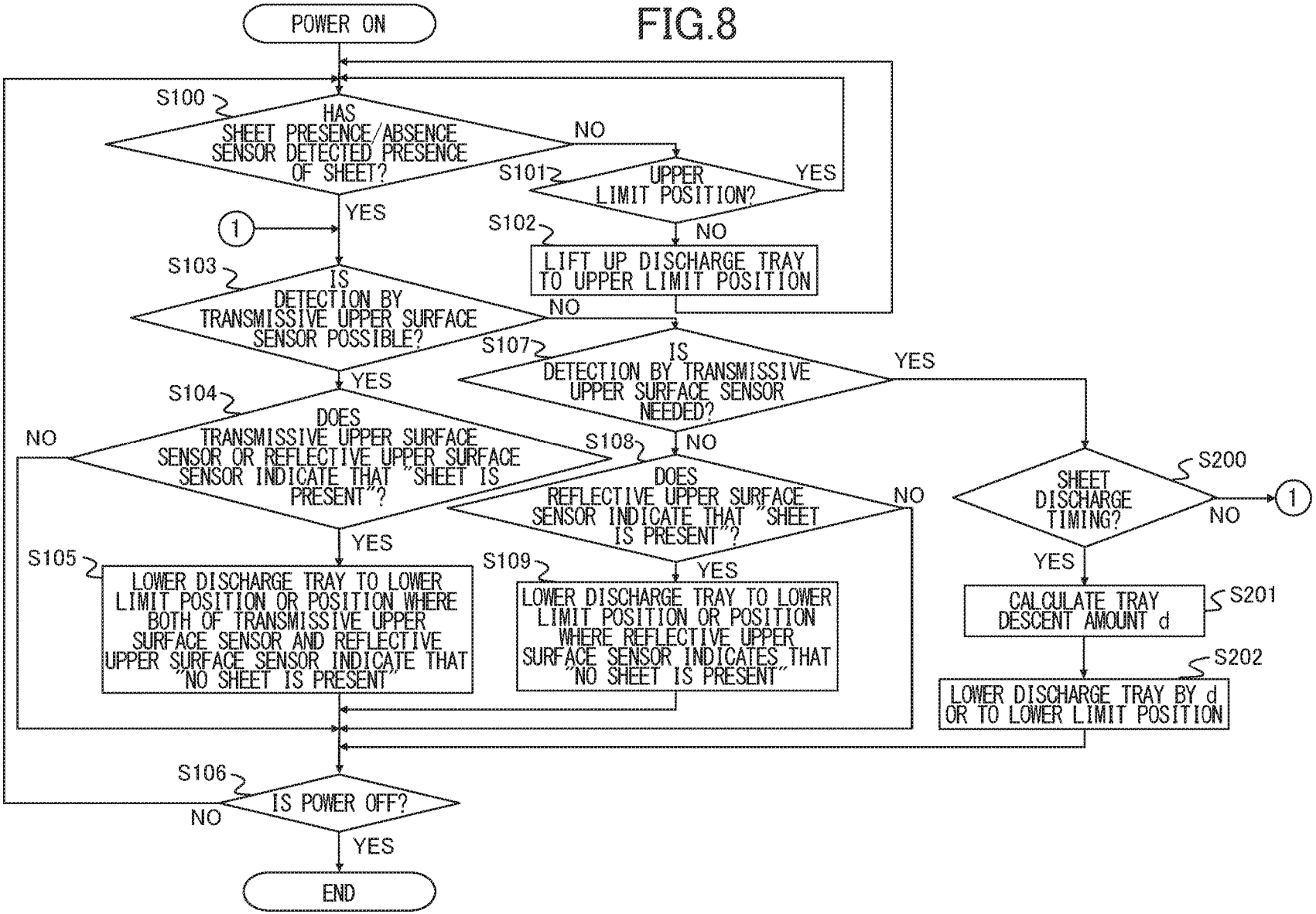
FIG. 8 is a flowchart of lifting/lowering control of a discharge tray according to the second embodiment.

Next, the lifting/lowering control of the discharge tray 37 in the present embodiment will be described with reference to a flowchart of FIG. 8. To be noted, steps having the same processing as in the flowchart of FIG. 6 of the first embodiment are denoted by the same step numbers, and description thereof will be omitted.

In the case where the detection necessity determining portion 84 has determined that sheet detection by the transmissive upper surface sensor 51 is "needed" in step S107, the lifting controller 80 stands by for discharge of a sheet onto the discharge tray 37 in step S200. When no sheet is discharged onto the discharge tray 37, the process returns to step S103. In the present embodiment, it is determined that a sheet has been discharged onto the discharge tray 37 at a timing at which the trailing end of the sheet has reached the bundle discharge rollers 36. In the case where it has been determined that a sheet has been discharged onto the discharge tray 37, the tray descent amount calculation portion 85 calculates a tray descent amount d by using the following formula (1) in step S201.

$$\text{tray descent amount } d[\text{mm}] = (\text{number of sheets} \times \text{sheet thickness}) + \text{base offset amount} + \text{post-processing offset amount} \quad (1)$$

The number of sheets is the number of sheets in a sheet bundle discharged by the bundle discharge rollers 36 in one time. The sheet thickness is the thickness of each sheet in the sheet bundle discharged by the bundle discharge rollers 36 in one time. The main controller 101 obtains the number of sheets and the sheet thickness by communicating with the controller 119. The sheet thickness is specified in units of 0.01 mm, for example. The base offset amount is a value set in consideration of deformation of discharged sheets, and is 1.5 mm in the present embodiment. The post-processing offset amount is determined in accordance with the type of processing performed on the sheet bundle to be discharged, and is 2 mm for a stapled sheet bundle, and 0 mm for a non-stapled sheet bundle in the present embodiment.

The method for calculating the tray descent amount d is not limited to the formula (1) described above as long as a value that enables suppressing occurrence of a jam caused by collision between sheets discharged from the bundle discharge rollers 36 with sheets already supported on the discharge tray 37, and suppressing droppage of the already supported sheets from the discharge tray 37. For example, the base offset amount may be set to a sufficiently large value, or a calculation formula for more accurately estimating the deformation of sheets by using the information about the sheets such as the grammage of the sheets, the grain direction of the sheets, information about a surface of sheets on which printing is to be performed, the size of the sheets, and the sheet-installed environment.

In the present embodiment, for example, in the case of a sheet bundle obtained by stapling 10 thick sheets each having a thickness of 0.12 mm, the tray descent amount d calculated on the basis of the formula (1) is 4.7 mm. Next, in step S109, the lifting controller 80 rotates the lifting motor 55 in the second direction by a number of steps corresponding to the tray descent amount d. In the present embodiment, since the lifting motor 55 is configured to lift or lower the discharge tray 37 by 0.01 mm by 1-step drive, in the case where the tray descent amount d is 4.2 mm, the number of steps is 420. In the case where the detection result of the lower limit sensor 54 indicates that the discharge tray 37 has reached the lower limit position while descending, the lifting controller 80 stops the lifting motor 55 to finish the descent of the discharge tray 37, and proceeds to step S106.

As described above, in the present embodiment, in the case where the detectability determining portion 83 and the detection necessity determining portion 84 have determined that sheet detection by the transmissive upper surface sensor 51 is "impossible" and "needed", that is, in the case where the result of step S103 is NO and the result of step S107 is YES, the lifting/lowering control is performed on the basis of an estimated tray descent amount d. In other words, in the case where the amount of light received by the first light receiving portion in the state in which the first light emitting portion is not emitting light is a second amount corresponding to High in Table 3 and the grammage of the sheet to be discharged by the discharging portion and the humidity of the environment in which the sheet has been placed satisfy predetermined conditions, which is a case corresponding to "Needed" of Table 4, the supporting portion is lifted or lowered by the lifting portion in accordance with discharge of sheets by the discharging portion. Therefore, by setting a calculation method for the tray descent amount d in advance in consideration of the influence of the curling of the sheets and the like, the discharge of sheets can be continued while suppressing the possibility of occurrence of a discharge failure or the like caused by the curling. That is, discharge of sheets can be continued as long as possible while suppressing the possibility of erroneous operation caused by the influence of disturbance light or the like.

Modification Example

Although the discharge tray 37 is lifted to the upper limit position on the basis of the detection result of the sheet presence/absence sensor 50 in the first embodiment and the second embodiment described above, the lifting control of the discharge tray 37 may be performed by a different method. As a modification example, a method of performing the lifting/lowering control of the discharge tray 37 by using the transmissive upper surface sensor 51 and the reflective upper surface sensor 52 will be described.

Figure 9:
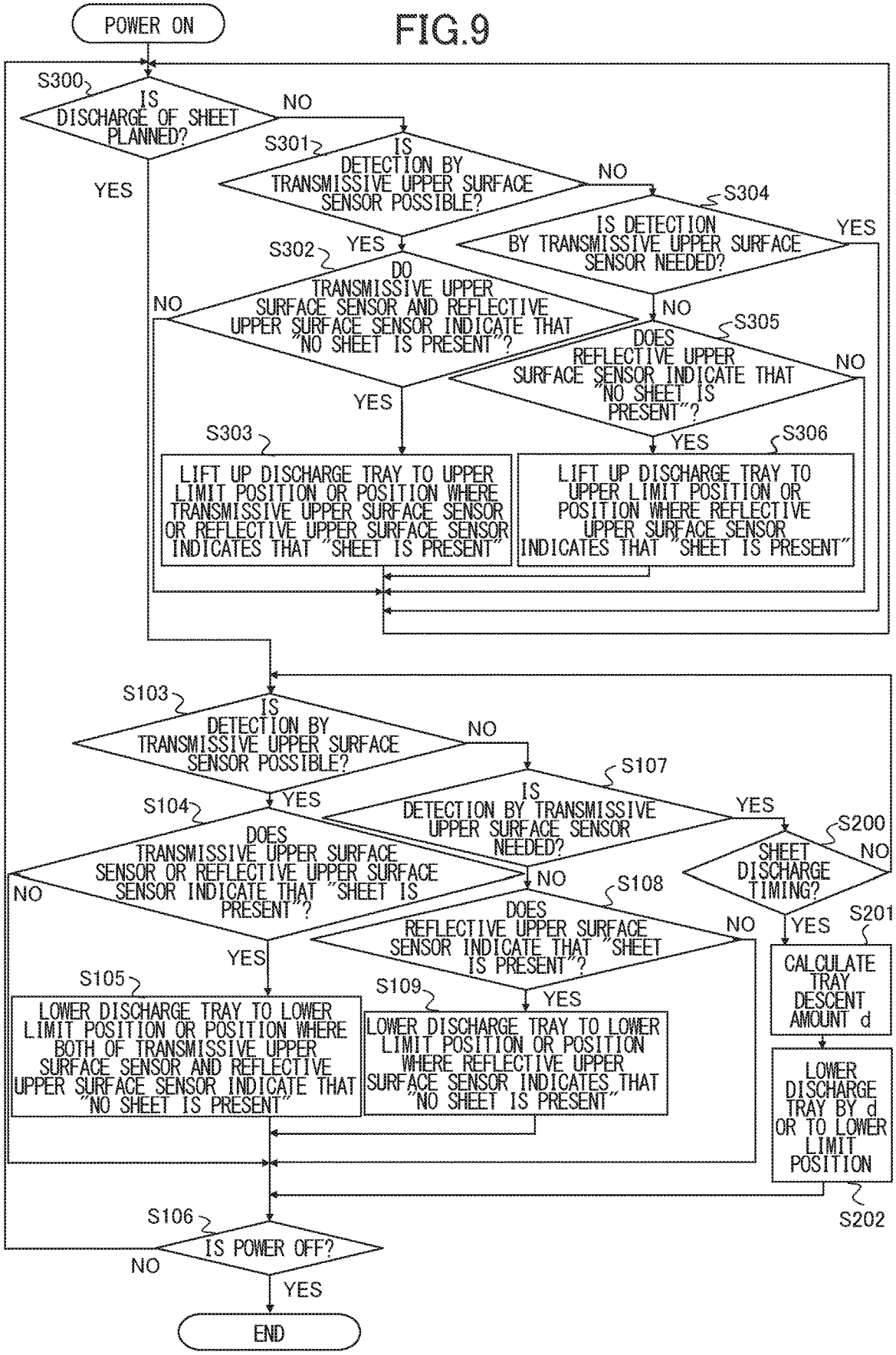
FIG. 9 is a flowchart of lifting/lowering control of a discharge tray according to a modification example.

FIG. 9 is a flowchart illustrating lifting/lowering control of the discharge tray 37 according to the present modification example. To be noted, steps of substantially the same processing as in the flowchart of FIG. 8 of the second embodiment will be denoted by the same step numbers and description thereof will be omitted.

First, in step S300, the lifting controller 80 obtains, from the controller 119, whether or not there is a plan to discharge a sheet onto the discharge tray 37. Processing performed in the case where there is a plan to discharge a sheet onto the discharge tray 37 is the same as in steps S103 to S109 and S200 to S202 of the flowchart of FIG. 8 according to the second embodiment, and redundant description will be omitted. In the case where there is no plan to discharge a sheet onto the discharge tray 37 in step S300, the lifting controller 80 performs lifting control of the discharge tray 37 by using the transmissive upper surface sensor 51 and the reflective upper surface sensor 52 by processing of steps S301 to S306.

In step S301, the detectability determining portion 83 determines whether or not sheet detection by the transmissive upper surface sensor 51 is possible. In the case where sheet detection by the transmissive upper surface sensor 51 is "possible", it is determined in step S302 whether or not the detection results of both the transmissive upper surface sensor 51 and the reflective upper surface sensor 52 indicate that "no sheet is present". In the case where the detection results of both the transmissive upper surface sensor 51 and the reflective upper surface sensor 52 indicate that "no sheet is present", the lifting controller 80 rotates the lifting motor 55 in the first direction in step S303. Then, the discharge tray 37 is lifted up to a position where the detection result of one of the transmissive upper surface sensor 51 and the reflective upper surface sensor 52 indicates that "a sheet is present". In addition, in the case where the detection result of the upper limit sensor 53 indicates that the discharge tray 37 has reached the upper limit position while the discharge tray 37 is ascending, the lifting controller 80 stops the lifting motor 55 to finish the ascent of the discharge tray 37, and returns to step S300. In the case where the detection result of the transmissive upper surface sensor 51 or the reflective upper surface sensor 52 indicates that "a sheet is present" in step S302, the lifting controller 80 returns to step S300 without lifting the discharge tray 37.

In the case where sheet detection by the transmissive upper surface sensor 51 is "impossible" in step S301, the detection necessity determining portion 84 determines in step S304 whether or not sheet detection by the transmissive upper surface sensor 51 is needed. In the case where sheet detection by the transmissive upper surface sensor 51 is "not needed", whether or not the detection result of the reflective upper surface sensor 52 indicates that "no sheet is present" is determined in step S305. In the case where the result of the reflective upper surface sensor 52 indicates that "no sheet is present", the lifting controller 80 rotates the lifting motor 55 in the first direction in step S306, and thus lifts up the discharge tray 37 to a position where the detection result of the reflective upper surface sensor 52 indicates that "a sheet is present". In addition, in the case where the detection result of the upper limit sensor 53 indicates that the discharge tray 37 has reached the upper limit position while the discharge tray 37 is ascending, the lifting controller 80 stops the lifting motor 55 to finish the ascent of the discharge tray 37, and returns to step S300. In the case where the detection result of the reflective upper surface sensor 52 indicates that "a sheet is present" in step S305, the lifting controller 80 returns to step S300 without lifting the discharge tray 37.

According to the processing described above, the discharge tray 37 can be lifted up to an appropriate position in accordance with the amount of supported sheets in a configuration in which the sheet presence/absence sensor 50 is omitted.

OTHER EMBODIMENTS

In the embodiments described above, the sheet processing apparatus 4 directly connected to the image forming apparatus 1 has been described as an example of a sheet processing apparatus. However, the present technique can be also applied to a sheet processing apparatus that receives a sheet from the image forming apparatus 1 via an intermediate unit. For example, the intermediate unit is a relay conveyance unit that is attached to a discharge space in an image forming apparatus of an in-body discharge type. In addition, examples of an image forming system include an image forming system in which modules having the functions of the image forming apparatus 1 and the sheet processing apparatus 4 are incorporated in a single casing.

In addition, the stapler 57 is an example of a processing portion that processes sheets, and for example, a sheet bundle aligned on the intermediate supporting portion may be discharged onto the discharge tray 37 without being stapled. In addition, the sheet discharging portion 100 provided in the sheet processing apparatus 4 is an example of a sheet discharging apparatus, and the present technique can be also applied to a sheet discharging apparatus that discharges a sheet serving as a recording material on which an image has been formed by the image forming apparatus to the outside of the image forming apparatus.

The discharging portion that discharges a sheet in the sheet discharging portion 100 is not limited to a roller pair that nips and conveys the sheet, and for example, sheets may be pushed out of the casing of the sheet processing apparatus 4 by the bundle discharge guide 34 serving as a discharging portion.

The inner configuration of the sheet processing apparatus 4 illustrated in FIG. 1 and so forth is merely an example, and the layout of conveyance paths and so forth in the sheet processing apparatus may be changed. For example, instead of a configuration in which the discharge destination of sheets is switched in accordance with whether or not reverse conveyance by the reverse conveyance rollers 24 is performed, a flap-shaped guide member that switches a conveyance path between the conveyance path to the upper discharge tray 25 and the conveyance path to the binding processing portion 4A may be disposed downstream of the inlet rollers 21.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-134814, filed on Aug. 7, 2020, which is hereby incorporated by reference herein in its entirety.

What is claimed is:

1. A sheet discharging apparatus comprising:

a discharging portion configured to discharge a sheet;

a supporting portion configured to support the sheet discharged by the discharging portion;

a lifting portion configured to lift and lower the supporting portion;

a transmissive sensor comprising a first light emitting portion configured to emit light and a first light receiving portion configured to detect the light received from the first light emitting portion, the transmissive sensor being configured to output an output signal that changes in accordance with a position of an upper surface of the sheet supported by the supporting portion;

a reflective sensor comprising a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion; and a controller configured to control the lifting portion and comprising a first determining portion configured to determine whether or not sheet detection by the transmissive sensor is possible and a second determining portion configured to determine whether or not sheet detection by the transmissive sensor is needed, wherein the controller is configured to, in a case where the first determining portion has determined that sheet detection by the transmissive sensor is possible, lift or lower the supporting portion by the lifting portion on a basis of the output signals of the transmissive sensor and the reflective sensor, in a case where the first determining portion has determined that sheet detection by the transmissive sensor is not possible and the second determining portion has determined that sheet detection by the transmissive sensor is not needed, lift or lower the supporting portion by the lifting portion on a basis of the output signal of the reflective sensor, and in a case where the first determining portion has determined that sheet detection by the transmissive sensor is not possible and the second determining portion has determined that sheet detection by the transmissive sensor is needed, stop discharge of a sheet to be discharged by the discharging portion.

2. The sheet discharging apparatus according to claim 1, wherein, as viewed from above, an optical axis direction of the light emitted from the first light emitting portion and an optical axis direction of the light emitted from the second light emitting portion intersect with each other.

3. The sheet discharging apparatus according to claim 2, wherein the transmissive sensor is configured such that the first light emitting portion and the first light receiving portion oppose each other in a sheet width direction perpendicular to a sheet discharging direction of the discharging portion and the first light receiving portion detects light emitted from the first light emitting portion in the sheet width direction across a space above the supporting portion, and the reflective sensor is configured such that the second light emitting portion and the second light receiving portion are disposed upstream of the supporting portion in the sheet discharging direction and the second light receiving portion detects light emitted downstream in the sheet discharging direction from the second light emitting portion and then reflected upstream in the sheet discharging direction by a sheet.

4. The sheet discharging apparatus according to claim 3, wherein the optical axis of the light emitted from the first light emitting portion passes through a space below the optical axis of the light emitted from the second light emitting portion.

5. The sheet discharging apparatus according to claim 1, wherein, in a case where an amount of light received by the first light receiving portion when the first light emitting portion is off is smaller than a predetermined standard, the first determining portion determines that sheet detection by the transmissive sensor is possible, and in a case where the amount of light received by the first light receiving portion when the first light emitting portion is off is larger than the predetermined standard, the first determining portion determines that sheet detection by the transmissive sensor is impossible.

6. The sheet discharging apparatus according to claim 1, wherein in a case where a grammage of a sheet to be discharged by the discharging portion is a first grammage, the second determining portion determines that sheet detection by the transmissive sensor is not needed, and in a case where the grammage of the sheet to be discharged by the discharging portion is a second grammage smaller than the first grammage, the second determining portion determines that sheet detection by the transmissive sensor is needed.

7. The sheet discharging apparatus according to claim 1, wherein in a case where an environmental humidity is a first humidity, the second determining portion determines that sheet detection by the transmissive sensor is not needed, and in a case where the environmental humidity is a second humidity higher than the first humidity, the second determining portion determines that sheet detection by the transmissive sensor is needed.

8. The sheet discharging apparatus according to claim 1, wherein in a case where a grammage of a sheet to be discharged by the discharging portion is a first grammage, the second determining portion determines that sheet detection by the transmissive sensor is not needed, and in a case where an environmental humidity is a first humidity, the second determining portion determines that sheet detection by the transmissive sensor is not needed, and in a case where the grammage of the sheet to be discharged by the discharging portion is a second grammage smaller than the first grammage and the environmental humidity is a second humidity higher than the first humidity, the second determining portion determines that sheet detection by the transmissive sensor is needed.

9. The sheet discharging apparatus according to claim 8, wherein the controller is configured to communicate with an apparatus comprising a storage chamber that accommodates a sheet and a sensor that detects a humidity in the storage chamber, and thus obtain the humidity detected by the sensor as the environmental humidity.

10. The sheet discharging apparatus according to claim 1, wherein the controller is configured such that, in a case where the supporting portion is lifted or lowered by the lifting portion on the basis of the output signals of the transmissive sensor and the reflective sensor, if the transmissive sensor or the reflective sensor has output an output signal indicating that a sheet has been detected, the supporting portion is lowered by the lifting portion to a position where the transmissive sensor and the reflective sensor output signals indicating that no sheet is detected, and in a case where the supporting portion is lifted or lowered by the lifting portion on the basis of the output signal of the reflective sensor, if the reflective sensor has output an output signal indicating that a sheet has been detected, the supporting portion is lowered by the lifting portion to a position where the reflective sensor outputs an output signal indicating that no sheet is detected.

11. A sheet processing apparatus comprising:

a processing portion configured to process a sheet; and the sheet discharging apparatus according to claim 1 configured to discharge the sheet processed by the processing portion.

12. An image forming system comprising:

an image forming portion configured to form an image on a sheet; and the sheet discharging apparatus according to claim 1 configured to discharge the sheet on which an image has been formed by the image forming portion.

13. A sheet discharging apparatus comprising:

a discharging portion configured to discharge a sheet;

a supporting portion configured to support the sheet discharged by the discharging portion;

a lifting portion configured to lift and lower the supporting portion;

a transmissive sensor comprising a first light emitting portion configured to emit light and a first light receiving portion configured to detect the light received from the first light emitting portion, the transmissive sensor being configured to output an output signal that changes in accordance with a position of an upper surface of the sheet supported by the supporting portion;

a reflective sensor comprising a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion; and a controller configured to control the lifting portion and comprising a first determining portion configured to determine whether or not sheet detection by the transmissive sensor is possible and a second determining portion configured to determine whether or not sheet detection by the transmissive sensor is needed, wherein the controller is configured to, in a case where the first determining portion has determined that sheet detection by the transmissive sensor is possible, lift or lower the supporting portion by the lifting portion on a basis of the output signals of the transmissive sensor and the reflective sensor, in a case where the first determining portion has determined that sheet detection by the transmissive sensor is not possible and the second determining portion has determined that sheet detection by the transmissive sensor is not needed, lift or lower the supporting portion by the lifting portion on a basis of the output signal of the reflective sensor, and in a case where the first determining portion has determined that sheet detection by the transmissive sensor is not possible and the second determining portion has determined that sheet detection by the transmissive sensor is needed, lift or lower the supporting portion by the lifting portion on a basis of information about a sheet to be discharged by the discharging portion.

14. The sheet discharging apparatus according to claim 13, wherein the information about the sheet to be discharged by the discharging portion comprises a number of sheets to be discharged and thickness of each of the sheets to be discharged.

15. The sheet discharging apparatus according to claim 13, wherein the information about the sheet to be discharged by the discharging portion comprises at least one of a grammage of the sheet to be discharged, a grain direction of the sheet to be discharged, information indicating simplex printing or duplex printing, a size of the sheet to be discharged, a type of processing performed on the sheet to be discharged, a temperature of an environment in which the sheet to be discharged has been placed, and a humidity of the environment in which the sheet to be discharged has been placed.

16. A sheet discharging apparatus comprising:

a discharging portion configured to discharge a sheet;

a supporting portion configured to support the sheet discharged by the discharging portion;

a lifting portion configured to lift and lower the supporting portion;

a transmissive sensor comprising a first light emitting portion configured to emit light and a first light receiving portion configured to detect the light received from the first light emitting portion, the transmissive sensor being configured to output an output signal that changes in accordance with a position of an upper surface of the sheet supported by the supporting portion;

a reflective sensor comprising a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion; and a controller configured to control the lifting portion, wherein the controller is configured to, in a case where an amount of light received by the first light receiving portion in a state in which the first light emitting portion is not emitting light is a first amount, lift or lower the supporting portion by the lifting portion on a basis of the output signals of the transmissive sensor and the reflective sensor, and in a case where the amount of light received by the first light receiving portion in the state in which the first light emitting portion is not emitting light is a second amount larger than the first amount, (i) if a grammage of the sheet to be discharged by the discharging portion is a first grammage, lift or lower the supporting portion by the lifting portion on a basis of the output signal of the reflective sensor, (ii) if an environmental humidity is a first humidity, lift or lower the supporting portion by the lifting portion on the basis of the output signal of the reflective sensor, and (iii) if the grammage of the sheet to be discharged by the discharging portion is a second grammage smaller than the first grammage and the environmental humidity is a second humidity higher than the first humidity, stop discharge of the sheet to be discharged by the discharging portion.

17. A sheet discharging apparatus comprising:

a discharging portion configured to discharge a sheet;

a supporting portion configured to support the sheet discharged by the discharging portion;

a lifting portion configured to lift and lower the supporting portion;

a transmissive sensor comprising a first light emitting portion configured to emit light and a first light receiving portion configured to detect the light received from the first light emitting portion, the transmissive sensor being configured to output an output signal that changes in accordance with a position of an upper surface of the sheet supported by the supporting portion;

a reflective sensor comprising a second light emitting portion configured to emit light and a second light receiving portion configured to detect the light emitted from the second light emitting portion and then reflected on a sheet, the reflective sensor being configured to output an output signal that changes in accordance with the position of the upper surface of the sheet supported by the supporting portion; and a controller configured to control the lifting portion, wherein the controller is configured to, in a case where an amount of light received by the first light receiving portion in a state in which the first light emitting portion is not emitting light is a first amount, lift or lower the supporting portion by the lifting portion on a basis of the output signals of the transmissive sensor and the reflective sensor, and in a case where the amount of light received by the first light receiving portion in the state in which the first light emitting portion is not emitting light is a second amount larger than the first amount, (i) if a grammage of a sheet to be discharged by the discharging portion is a first grammage, lift or lower the supporting portion by the lifting portion on a basis of the output signal of the reflective sensor, (ii) if an environmental humidity is a first humidity, lift or lower the supporting portion by the lifting portion on the basis of the output signal of the reflective sensor, and (iii) if the grammage of the sheet to be discharged by the discharging portion is a second grammage smaller than the first grammage and the environmental humidity is a second humidity higher than the first humidity, lift or lower the supporting portion by the lifting portion in response to discharge of a sheet by the discharging portion.

* * * * *